US011213174B2

(12) United States Patent
Yoo et al.

(10) Patent No.: US 11,213,174 B2
(45) Date of Patent: Jan. 4, 2022

(54) DRYER

(71) Applicant: LG ELECTRONICS INC., Seoul (KR)

(72) Inventors: Hyunsun Yoo, Seoul (KR); Jaehung Chun, Seoul (KR); Yousook Eun, Seoul (KR); Joogyeom Kim, Seoul (KR); Sungkyung Kim, Seoul (KR); Myongsun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 166 days.

(21) Appl. No.: 16/576,291

(22) Filed: Sep. 19, 2019

(65) Prior Publication Data

US 2020/0085252 A1 Mar. 19, 2020

Related U.S. Application Data

(60) Provisional application No. 62/733,478, filed on Sep. 19, 2018.

(30) Foreign Application Priority Data

Nov. 29, 2018 (KR) ..... 10-2018-0151298
Dec. 12, 2018 (KR) ..... 10-2018-0159897
Aug. 30, 2019 (KR) ..... 10-2019-0107606

(51) Int. Cl.
*A47K 10/48* (2006.01)
*A45D 20/12* (2006.01)
(Continued)

(52) U.S. Cl.
CPC ..... *A47K 10/48* (2013.01); *A45D 20/12* (2013.01); *F04D 19/002* (2013.01);
(Continued)

(58) Field of Classification Search
CPC ..... A47K 10/48; A45D 20/12; F04D 19/002; F04D 29/325; F04D 29/388; F04D 19/007; F04D 19/024; F05D 2210/40
(Continued)

(56) References Cited

U.S. PATENT DOCUMENTS 3,594,916 A * 7/1971 Mason ..... A45D 20/44 34/98
3,868,495 A * 2/1975 Dyer ..... H05B 3/16 392/384
(Continued)

FOREIGN PATENT DOCUMENTS

CN 105559311 A 5/2016
EP 3626106 A3 * 7/2020 ..... F04D 29/388
(Continued)

*Primary Examiner* — Stephen M Gravini
(74) *Attorney, Agent, or Firm* — Birch, Stewart, Kolasch & Birch, LLP

(57) ABSTRACT

A dryer includes a hollow casing, a fan disposed inside the casing so as to cause air to be introduced into the casing and to be discharged therefrom, a heater disposed inside the casing to heat the air introduced into the casing by the fan, and a discharge tube including an inlet into which the air is introduced, and an outlet from which the air is discharged. The fan includes a first fan and a second fan, which rotate in opposite directions about an imaginary axis shared by the first and second fans. A discharge amount or a discharge rate can be controlled in a stepwise manner. The discharge tube is disposed inside the casing so as to be rotated in at least one direction, thereby diffusely discharging drying air to a region desired to be dried.

19 Claims, 20 Drawing Sheets

(51) Int. Cl.
*F04D 19/00* (2006.01)
*F04D 29/32* (2006.01)
*F04D 29/38* (2006.01)

(52) U.S. Cl.
CPC ..... *F04D 29/325* (2013.01); *F04D 29/388* (2013.01); *A45D 2020/128* (2013.01); *F05D 2210/40* (2013.01)

(58) Field of Classification Search
USPC ..... 34/95–100
See application file for complete search history.

(56) References Cited

U.S. PATENT DOCUMENTS 4,384,411 A * 5/1983 Stiegler ..... A45D 20/18 34/99
5,054,211 A * 10/1991 Shulman ..... A45D 20/124 34/97
5,161,317 A * 11/1992 McDougall ..... A45D 20/124 239/383
5,642,570 A * 7/1997 Lee ..... A45D 19/16 34/98
6,199,296 B1 * 3/2001 Jewitt ..... D21F 5/182 34/115
6,269,549 B1 * 8/2001 Carlucci ..... A45D 20/14 34/100
6,393,208 B1 * 5/2002 Nosenchuck ..... F04D 25/066 392/384
6,945,069 B2 * 9/2005 Lee ..... F25D 11/006 62/378
8,082,679 B1 * 12/2011 Arnim ..... A45D 20/10 34/97
8,302,324 B1 * 11/2012 Connelly ..... A45D 20/12 34/97
8,607,470 B2 * 12/2013 Richmond ..... A45D 20/10 34/90
8,707,577 B2 * 4/2014 Lee ..... A45D 20/12 34/97
9,282,799 B2 * 3/2016 Courtney ..... A45D 20/12
9,420,865 B2 * 8/2016 Gammack ..... A45D 20/10
9,687,058 B2 * 6/2017 Atkinson ..... A45D 20/122
9,693,616 B2 * 7/2017 Sakuma ..... A45D 20/12
9,883,726 B2 * 2/2018 Hsu ..... A45D 20/12
10,470,620 B2 * 11/2019 Jun ..... A61L 2/24
10,576,404 B2 * 3/2020 Park ..... F24F 8/192
10,914,033 B2 * 2/2021 Kim ..... D06F 58/30
10,953,248 B2 * 3/2021 Yu ..... F04D 19/007
2003/0079366 A1 5/2003 Chang
2006/0254073 A1 * 11/2006 Zhen ..... A45D 20/10 34/96
2007/0081888 A1 * 4/2007 Harrison ..... H05K 7/2019 415/47
2008/0138199 A1 * 6/2008 Chang ..... F04D 29/325 415/199.5
2011/0157560 A1 * 6/2011 Hsiao ..... G03B 21/16 353/58
2016/0316884 A1 * 11/2016 Ben-Hur ..... A45D 20/16
2020/0085252 A1 * 3/2020 Yoo ..... A47K 10/48
2020/0085253 A1 * 3/2020 Yoo ..... A45D 20/122
2020/0085256 A1 * 3/2020 Yoo ..... A45D 20/10
2020/0085259 A1 * 3/2020 Yoo ..... A45D 20/12
2020/0085261 A1 * 3/2020 Yoo ..... A47K 10/48
2020/0182252 A1 * 6/2020 Nakasuji ..... F04D 19/007

FOREIGN PATENT DOCUMENTS

GB 2 315 019 A 1/1998
JP 60-488503 U 12/1985
JP 61-31696 A 2/1986
JP 3-82402 A 4/1991
KR 10-1345488 B1 12/2013
KR 10-1490979 B1 2/2015
KR 10-2017-0065327 A 6/2017
KR 10-2017-0138927 A 12/2017

* cited by examiner

DRYER

CROSS-REFERENCE TO RELATED APPLICATIONS

This application claims the priority benefit of U.S. Provisional Application No. 62/733,478, filed on Sep. 19, 2018, Korean Patent Application No. 10-2018-0151298, filed on Nov. 29, 2018, Korean Patent Application No. 10-2018-0159897, filed on Dec. 12, 2018, and Korean Patent Application No. 10-2019-0107606, filed on Aug. 30, 2019, the entire disclosures of all of which are hereby expressly incorporated by reference into the present application.

BACKGROUND OF THE DISCLOSURE

Field of the Disclosure

The present disclosure relates to a dryer for discharging drying air, and more particularly, to a dryer capable of improving the flow of discharged air while increasing the intake rate of air, and capable of diffusely discharging drying air to a region to be dried as desired.

Description of the Related Art

When a dryer is used to dry a human body, the human body must be prevented from being burned, and the temperature of drying air must be maintained at a temperature that is comfortable to a user. Furthermore, a dryer must be designed to complete a desired drying operation as quickly as possible, to reduce noise attributable to the flow of air, and to make it convenient for a user to use the dryer.

Accordingly, there is a need to design a dryer taking into consideration not only the overall shape and size thereof and the temperature, discharge amount, discharge rate and discharge direction of drying air discharged therefrom, but also the characteristics of the body to be dried.

Particularly, when it is difficult to timely inform a user of the fact that an object to be dried, such as a child or a pet, suffers pain or discomfort during a drying operation, there is a need to design a dryer capable of performing a drying operation most appropriate for the characteristics of the object body to be dried. In other words, it is preferable to design a dryer such that the discharge temperature, discharge amount, discharge rate and discharge direction of drying air are automatically controlled based on variation in the characteristics of an object body to be dried or the conditions of the region to be dried (for example, the temperature). Furthermore, it is preferable to design a dryer that enables an object to be dried, such as a child or a pet, to enjoy the drying process while stimulating the object's curiosity during drying.

However, because a conventional dryer is constructed so as to discharge drying air using a single fan, there are problems in that overheating of the dryer and excessive noise and vibration occur when the fan is rotated at a high RPM in order to increase the discharge amount or a discharge rate of drying air. Furthermore, a conventional dryer has a problem in that it is difficult to control the discharge amount or a discharge speed of drying air in a stepwise manner according to the characteristics of the object to be dried using only the single fan provided in the dryer.

In order to solve the above problems, US 2003/0079366 A1 discloses a dryer in which a plurality of blades connected to a motor, which is rotated at a low speed, are spaced apart from each other by a predetermined interval so as to accelerate drying air in a stepwise manner. However, because the blades are constructed so as to individually introduce and discharge air, there is a limitation on the extent to which the discharge amount or the discharge rate of air can be controlled, like the above-mentioned dryer equipped with a single fan.

Unlike the above US publication, US 2006/0254073 A1 discloses a dryer constructed to accelerate drying air by means of two blades, which are coaxially disposed and rotated in the same direction. However, the dryer has a problem in that an additional vane must be provided between two blades in order to compensate for circumferential component velocity of the airflow passing by an upstream blade. The dryer also has a problem in that the efficiency of a fan is decreased due to the drag or frictional force caused by the additional vane.

In addition, because a conventional dryer is constructed such that an outlet, from which drying air is discharged, is fixedly disposed such that drying air is intensively discharged only in one direction, there is a problem in that it is difficult to perform a drying operation over a relatively wide region.

In order to solve the above problem, KR 10-1490979 B1 discloses a dryer, which is adapted to increase the discharge range of drying air by means of a rotating blade, which is disposed at an outlet and is rotated by airflow. However, there are problems in that noise and vibration occurs due to the operation of the rotating blade and in that drying air is excessively diffused, thereby decreasing drying performance. Furthermore, because the rotating blade always rotates, there is a problem in that it is difficult to intensively discharge drying air.

Unlike the above Korean patent, KR 2017-0065327 A discloses a nozzle for a dryer, which is adapted to control the discharge direction of air by rotating a flap provided in a nozzle, from which drying air is discharged, to the right or left side. However, because the nozzle is provided therein with a flap-driving motor and a direction-changing unit, the flow of air is obstructed. Furthermore, because the flap in the nozzle is automatically rotated about only one axis without automatic rotation of the nozzle itself, there is a limitation as to how diffusely the drying air is discharged.

SUMMARY OF THE DISCLOSURE

Therefore, the present disclosure has been made in view of the above problems, and it is a first object of the present disclosure to provide a dryer capable of minimizing the occurrence of overheating, noise or vibration attributable to operation of a fan, and capable of controlling a discharge amount or a discharge rate of drying air in a stepwise manner.

A second object of the present disclosure is to provide a dryer capable of ensuring the straightness of air discharge while increasing the intake rate of air.

A third object of the present disclosure is to provide a dryer capable of diffusely discharging drying air to a region desired to be dried.

A fourth object of the present disclosure is to provide a dryer capable of diffusely discharging drying air to a region to be dried while minimizing interference with the flow of drying air.

The objects of the present disclosure are not limited to the above-mentioned objects. Other specific details of the present disclosure will be apparent from the following detailed description and the embodiments of the present disclosure.

In accordance with an aspect of the present disclosure, the above and other objects can be accomplished by the provision of a dryer including a hollow casing, a fan disposed inside the casing so as to cause air to be introduced into the casing and to be discharged to an outside therefrom, a heater disposed inside the casing so as to heat the air, which is introduced into the casing by means of the fan, and a discharge tube, which is provided at one side thereof with an inlet, into which the air that has passed through the fan and the heater is introduced, and at another side thereof with an outlet, from which the air that has been introduced through the inlet is discharged. Here, the fan includes a first fan and a second fan, which are rotated in opposite directions about an imaginary axis, which is shared by the first and second fans, whereby it is possible to control the discharge amount or discharge rate of drying air in a stepwise manner.

Each of the first and second fans may be an axial flow fan and may include a fan motor including a rotating shaft, which extends along the imaginary axis, a hub to which the rotating shaft is connected, and a plurality of blades, which are coupled at first ends thereof to an outer peripheral surface of the hub and are provided at second ends thereof with tips.

The first fan may be positioned upstream of the second fan, wherein the blades of the first fan (hereinafter, referred to as "first blades") may be coupled to the outer peripheral surface of the hub (hereinafter, referred to as a "first hub") of the first fan so as to form first blade roots, wherein the blades of the second fan (hereinafter, referred to as "second blades") may be coupled to the outer peripheral surface of the hub (hereinafter, referred to as a "second hub") of the second fan so as to form second blade roots, and wherein the first blades and the second blades may be inclined in opposite directions, whereby it is possible for both the first and second fans to discharge air in the same direction.

The number of second blades may be larger than the number of first blades, and the casing may be disposed so as to surround the first fan and may be provided with a plurality of through holes in a side surface thereof corresponding to the outer periphery of the first fan, whereby it is possible to ensure the straightness of air discharge while increasing the intake rate of air.

The discharge tube may be disposed in the casing so as to be rotated in at least one direction, whereby it is possible to diffusely discharge drying air to a region to be dried.

The dryer may further include a cylindrical guide, which is disposed inside the casing and is provided in the inner peripheral surface thereof with a groove, and the discharge tube may include a protrusion, which is formed on the outer surface thereof and which is slidably moved in the state of being disposed in the groove.

The groove may form a closed curve in the inner peripheral surface of the guide and may form a circular shape, which extends in a circumferential direction in the inner peripheral surface of the guide, or may form a wave shape in the inner peripheral surface of the guide.

The dryer may further include a rotation motor, which is electrically activated, and a connector, which is connected at one end thereof to a rotating shaft of the rotation motor and at another end thereof to the discharge tube so as to transmit power from the rotation motor to the discharge tube, wherein the connector may extend in a direction orthogonal to the rotating shaft, and the discharge tube may be rotated both about the rotating shaft and about the longitudinal axis of the connector upon activation of the rotation motor, whereby it is possible to diffusely discharge drying air to a region to be dried while minimizing interference with the flow of drying air.

Means to solve the problems not mentioned above will be sufficiently derived from the following description of embodiments of the present disclosure.

BRIEF DESCRIPTION OF THE DRAWINGS

The above and other objects, features and other advantages of the present disclosure will be more clearly understood from the following detailed description taken in conjunction with the accompanying drawings, in which.

DESCRIPTION OF EXEMPLARY EMBODIMENTS

Reference will now be made in detail to embodiments, examples of which are illustrated in the accompanying drawings. However, the present disclosure may be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is defined only by the categories of the claims. In certain embodiments, detailed descriptions of device constructions or processes well known in the art may be omitted in order to avoid obscuring appreciation of the disclosure by a person of ordinary skill in the art. Wherever possible, the same reference numbers will be used throughout the drawings to refer to the same or like parts.

Hereinafter, a dryer 100 according to an embodiment of the present disclosure will be described with reference to FIGS. 1 to 6.

Figure 1:
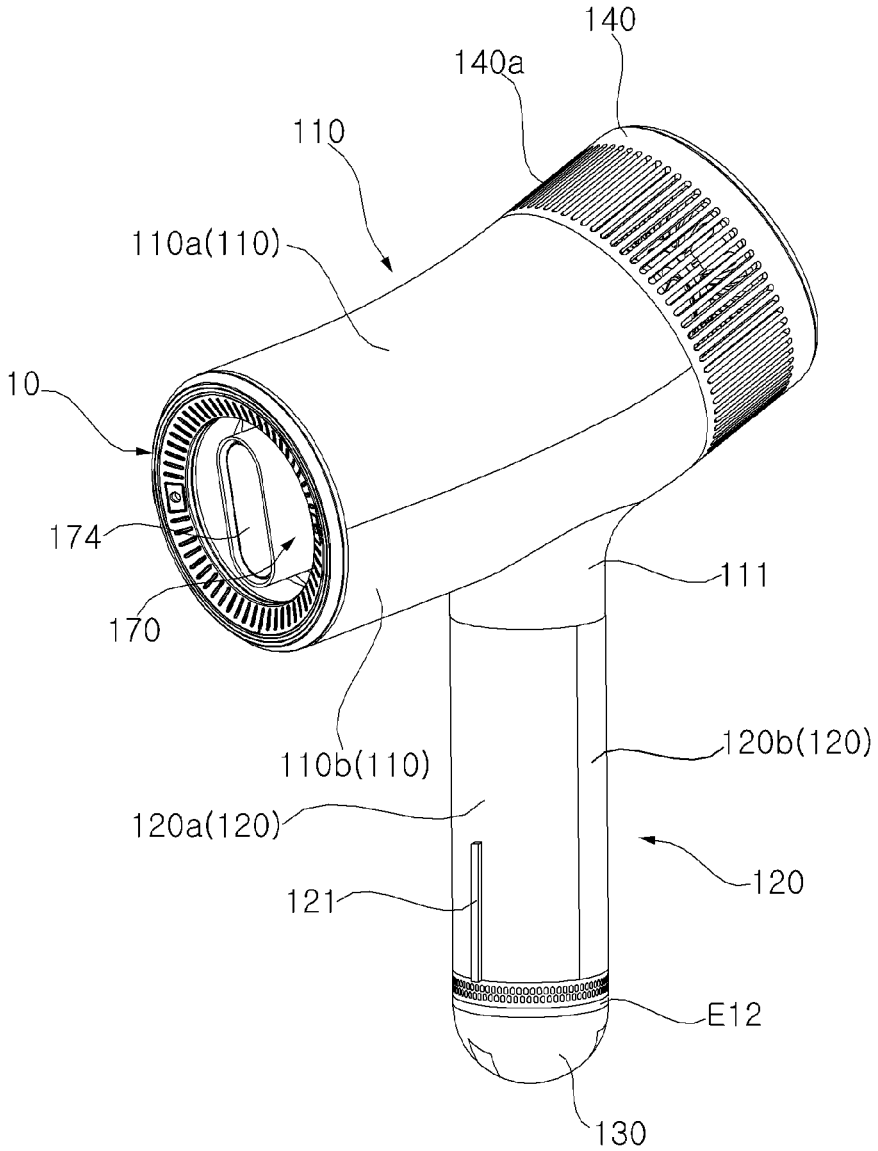
FIG. 1 is a perspective view of a dryer according to an embodiment of the present disclosure.

FIG. 1 is a perspective view of the dryer 100 according to the embodiment of the present disclosure.

Referring to FIG. 1, the dryer 100 is a device for drying a human or a pet using drying air discharged through an outlet 174 thereof.

By way of example, as will be described later, the dryer 100 is provided therein with a battery 80 so as to allow a user to carry the dryer 100 and to dry an object to be dried. In some embodiments, external power may be applied to the dryer 100 in a wired or wireless manner, in place of the battery 80. In this case, a user may also dry an object to be dried while gripping the dryer 100.

The dryer 100 may also serve various functions of caring for an object to be dried, in addition to the discharge of drying air. The various functions will now be briefly described in connection with associated components provided in the dryer 100.

Figure 2:
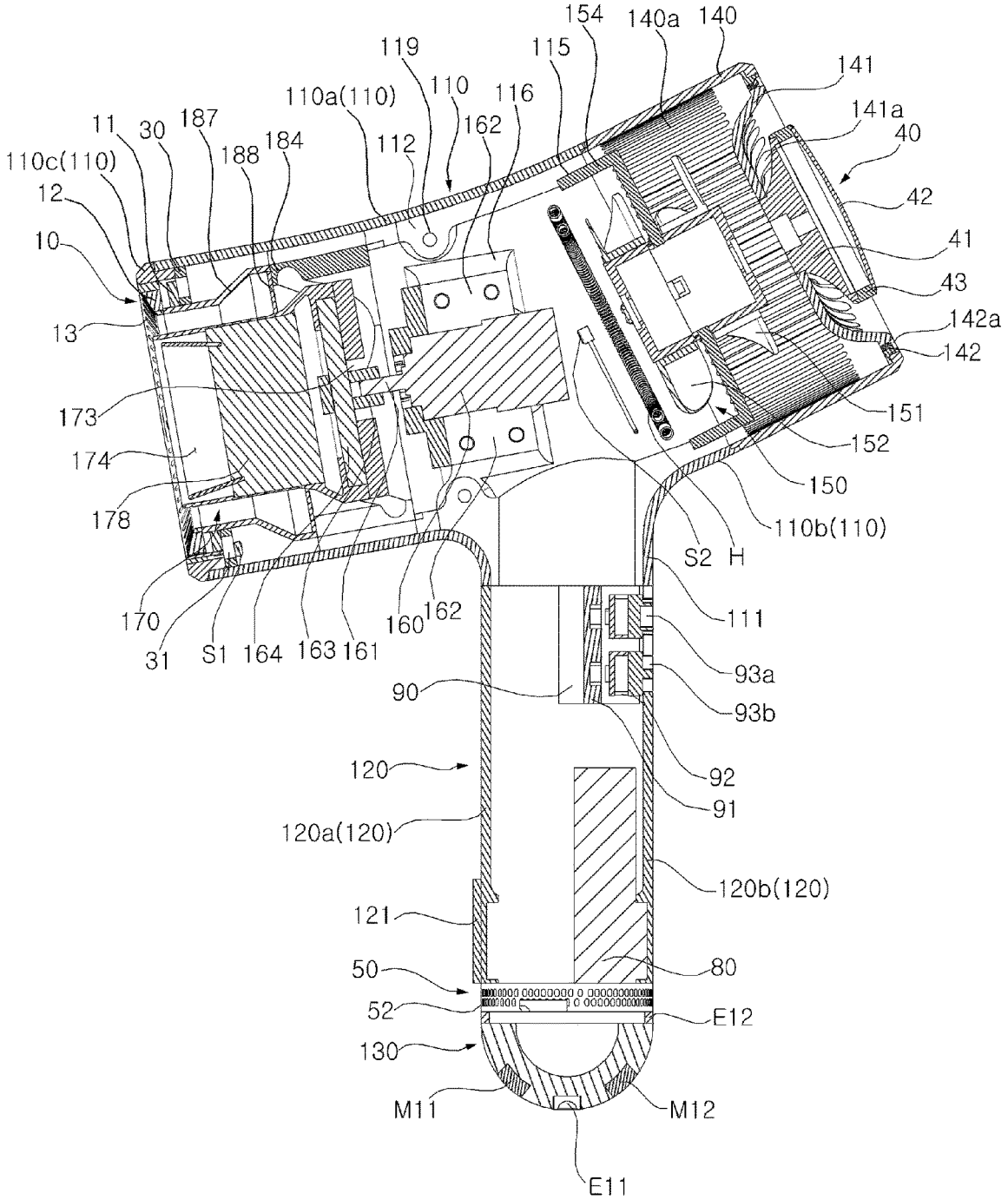
FIG. 2 is a longitudinal cross-sectional view of the dryer according to the embodiment of the present disclosure.
Figure 3A:
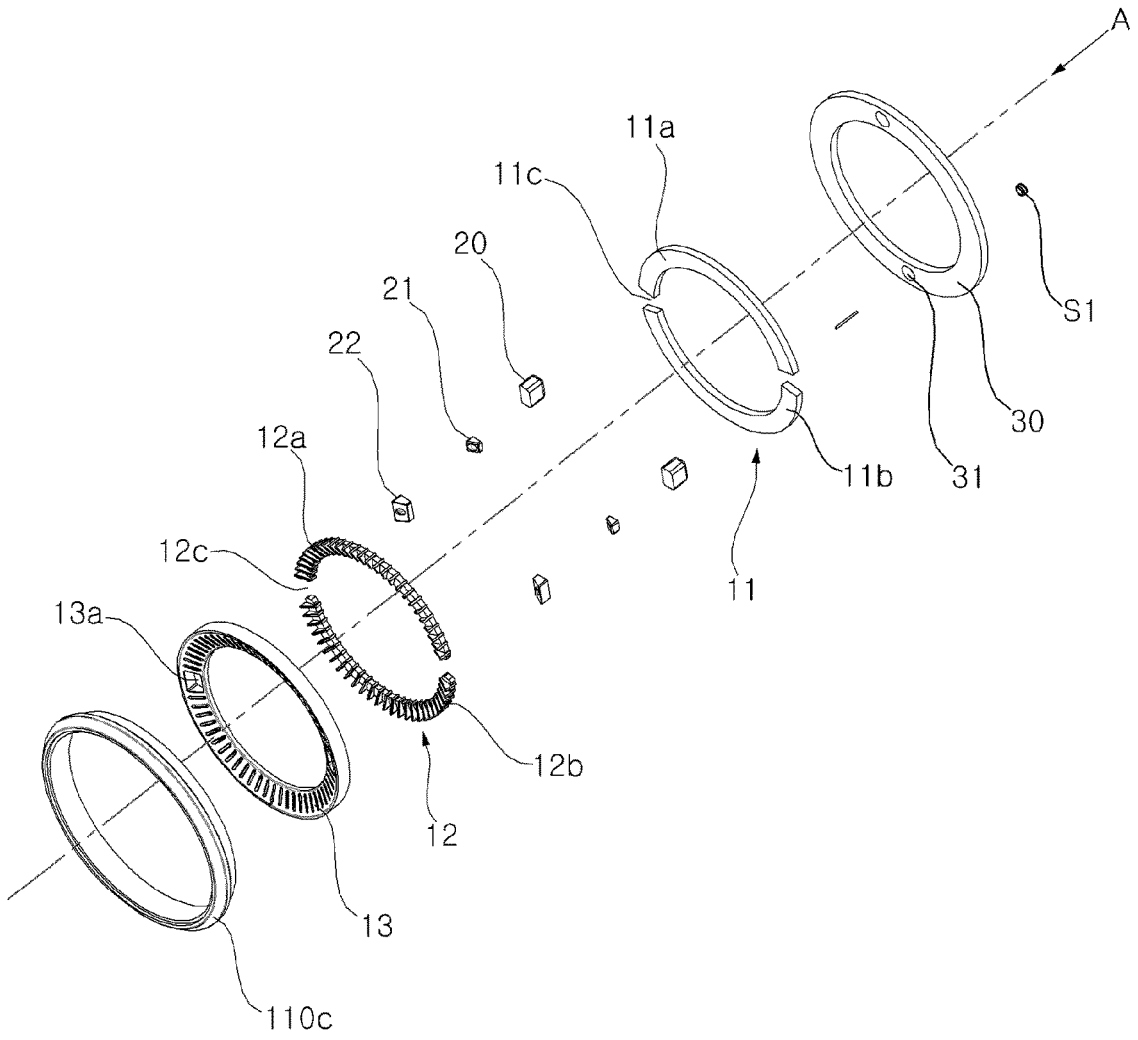
FIGS. 3A and 3B are exploded perspective views of several of the components of the dryer according to the embodiment of the present disclosure.
Figure 3B:
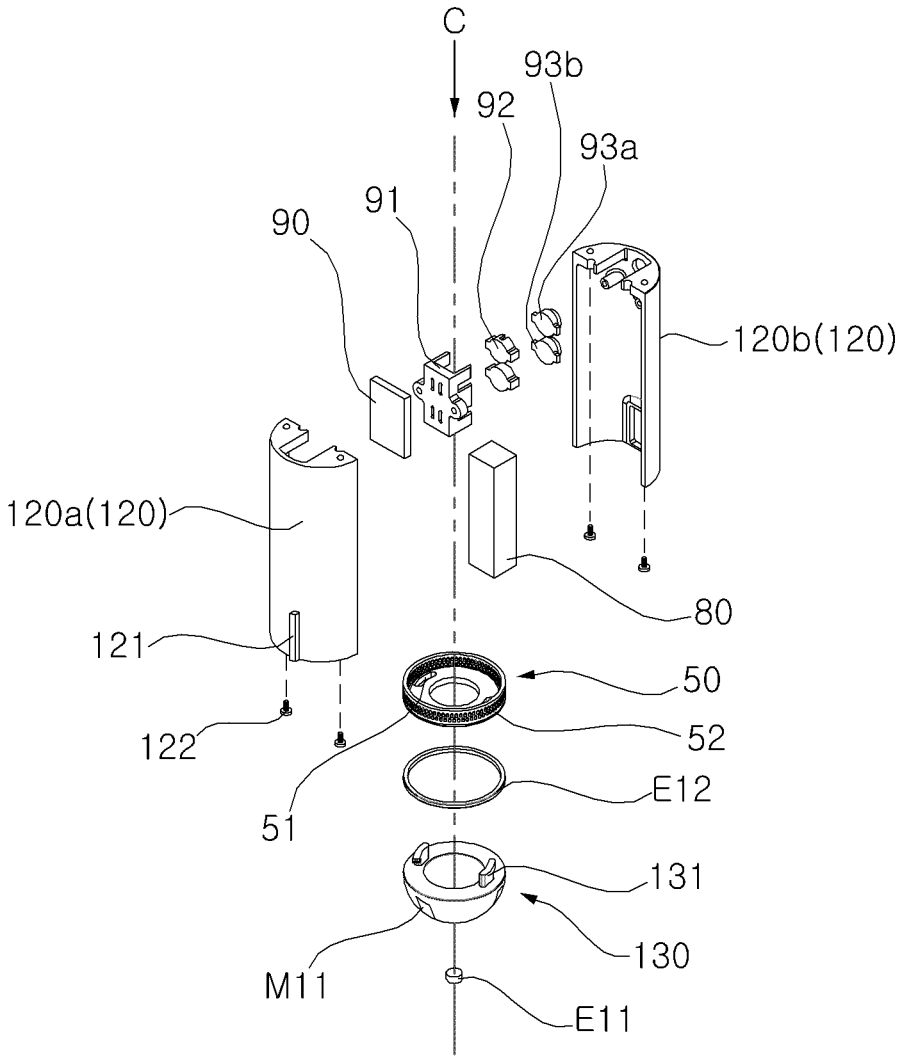

FIG. 2 is a longitudinal cross-sectional view of the dryer 100 according to the embodiment of the present disclosure. FIGS. 3A and 3B are exploded perspective views of several components of the dryer 100 according to the embodiment of the present disclosure.

Referring to FIG. 2, the dryer 100 includes a hollow casing 110, a fan 150 for causing air to be introduced into the casing 110 and then to be discharged to the outside, and a heater H for heating the air that is introduced into the casing 110 by means of the fan 150. The flow of air that is discharged to the outside of the casing 110 may be guided by a discharge tube 170.

Referring to FIGS. 2 and 3A, the dryer 100 may include a lighting unit 10 for emitting light forward of the dryer 100, and an ion generator 20 for generating ions. A light-emitting panel 11, which is provided in the lighting unit 10, is disposed in front of a fixing ring 30 having a pair of apertures 31 therein. The light-emitting panel 11 may be formed of two pieces 11*a* and 11*b* with gaps 11*c* therebetween. By way of example, since the light emitted from the light-emitting panel 11 is radiated forward from the dryer 100, it is possible to easily observe the states of the skin and the hair of an object to be dried even when a drying operation is performed in a dark place.

The light emitted from the light-emitting panel 11 is radiated through a light diffusion module 12 and a light guide 13 located behind a front cap 110*c*. The light diffusion module 12 may be formed of two pieces 12*a* and 12*b* with gaps 12*c* therebetween.

Since the ions generated by the ion generator 20 are discharged forward from the dryer 100 through an ion spray nozzle 21, it is possible to prevent foreign substances such as dust from adhering to an object to be dried, and to moisturize the skin and the hair of the object to be dried. The ion spray nozzle 21 is surrounded by an ionizer cover 22 inserted in an opening 13*a* formed in the light guide 13.

Referring to FIGS. 2 and 3B, a grip, including a grip body 120 and a grip end 130, which is gripped by a user, may be coupled to the lower portion 111 of the casing 110. The grip may include the grip body 120, including first and second grip portions 120*a* and 120*b* which define the peripheral surface of the grip, and the grip end 130 which is coupled to the lower portion of the grip body 120 so as to define the lower surface of the grip.

By way of example, the grip body 120 may be configured to have a cylindrical shape, and the grip end 130 may be configured to have a hemispherical shape. In other words, the outer periphery of the grip, hereinafter referred to as the grip 120 and 130, may be configured to have a circular cylindrical shape. A receptacle 220, in which the grip 120 and 130 is received, may also be configured to have an inner periphery having a circular cylindrical shape. The grip 120 and 130 may be provided with the rechargeable battery 80 therein for supplying power to the fan 150, the heater H, the lighting unit 10, the ion generator 20, a rotation motor 160 and a display unit 40.

A heat dissipating cap 50 having dissipation through holes 52 punched therein may be interposed between the grip body 120 and the grip end 130. The grip end 130 may be assembled with the grip body 120 by an insertion protrusion 131 that protrudes upwardly from an upper surface of the grip end 130. The insertion protrusion 131 of the grip end 130 may be forcibly inserted into a hole 51 in the heat dissipating cap 50 and thereby coupled to the heat dissipating cap 50. The first and second grip portions 120*a* and 120*b* may be coupled to a lower portion of the casing 110 by set screws 122.

Figure 4:
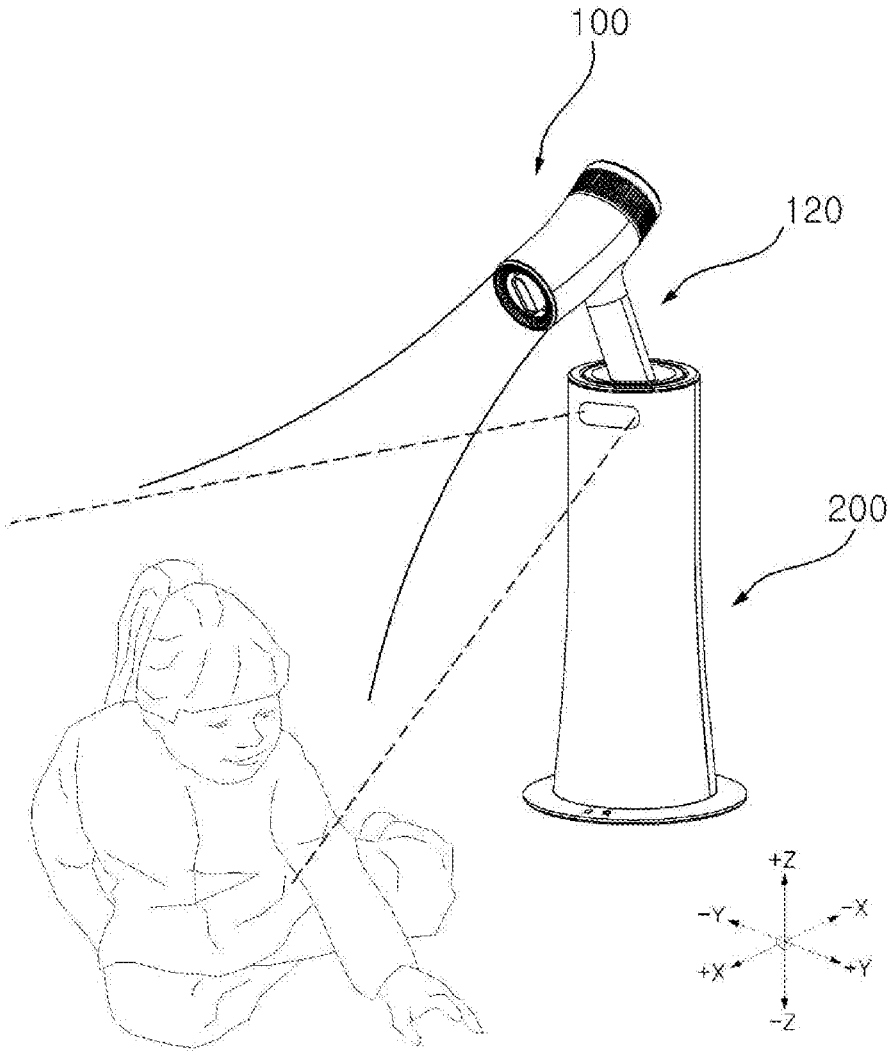
FIG. 4 is a view illustrating the operating state of a stand on which the dryer according to the embodiment of the present disclosure is mounted.

According to the embodiment, since the dryer 100 may be removably mounted on a stand 200, it is possible for a user to perform a drying operation on an object to be dried without gripping the dryer 100 (see FIG. 4). Accordingly, there is an advantage of making it possible for a user to perform a drying operation on an object to be dried without having to hold the dryer 100.

In this case, the stand 200 may serve various functions, such as providing therapy for an object to be dried and purifying indoor air, in addition to mounting the dryer 100 thereon. The various functions will now be briefly described in connection with the components provided in the stand 200.

Figure 5:
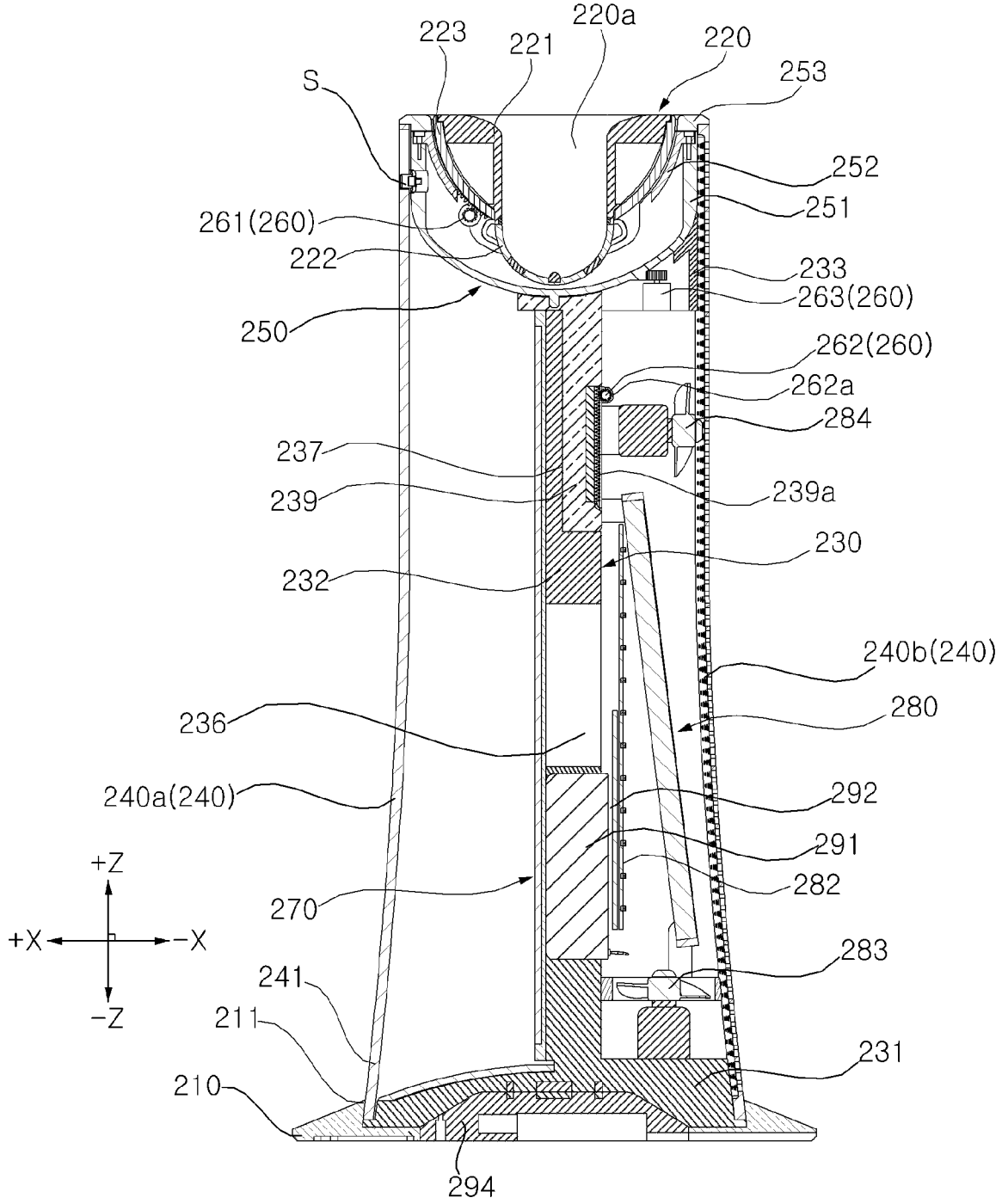
FIG. 5 is a longitudinal cross-sectional view of the stand according to the embodiment of the present disclosure.
Figure 6:
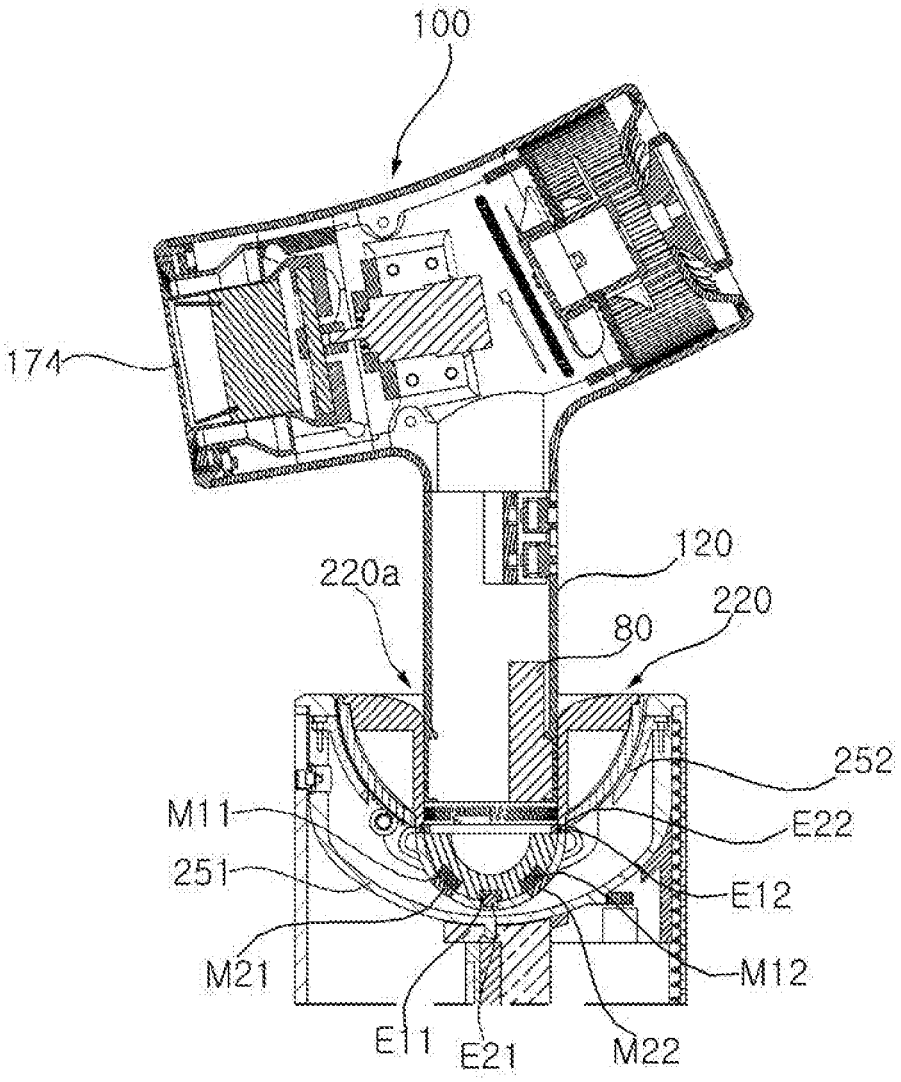
FIG. 6 is a cross-sectional view of the upper portion of the stand on which the dryer according to the embodiment of the present disclosure is mounted.

FIG. 4 is a view illustrating the operating state of the stand 200 on which the dryer 100 according to the embodiment of the present disclosure is mounted. FIG. 5 is a longitudinal cross-sectional view of the stand 200 according to the embodiment of the present disclosure. FIG. 6 is a cross-sectional view of the upper portion of the stand 200 on which the dryer 100 according to the embodiment of the present disclosure is mounted.

Referring to FIG. 5, the stand 200 includes a stem 230, which extends in an up-and-down direction or in a z-axis direction, a base 210 disposed below the stem 230, the receptacle 220 which is disposed on the stem 230 and which includes an upper tub 221 and a lower tub 222 configured to form a recess 220*a* into which the grip 120 and 130 is removably mounted, and a side cover 240 defining the side appearance of the stand 200. The receptacle 220 may include a tub cover 223. The side cover 240 may include a front cover 240*a* and a rear cover 240*b*. A lower end 241 of the side cover 240 may be inserted into a ring-shaped groove 211 formed by the base 210 and a lower plate 231.

The air in the indoor space in which the stand 200 is positioned may be introduced into the stand 200 and may then pass through an air purification unit 280 for purification of air by means of fans 283 and 284. By way of example, the air purification unit 280 may include a photocatalytic filter capable of eliminating unpleasant smells of pets by the principle by which harmful substances are decomposed through a photochemical reaction, and a light-emitting module 282 for activating the photocatalyst.

The stand 200 may include a light therapy unit 270 for radiating light forward. By way of example, the light therapy unit 270 may be disposed on the front surface of a vertical plate 232 of the stem 230 and may radiate light having a spectrum similar to natural light from an organic light-emitting diode (OLED) panel so as to assist in alleviating the symptoms of depression of a user or a pet attributable to insufficient time spent outdoors.

A plurality of electrically driven motors 260 may be provided in the stand 200. The plurality of electrically driven motors 260 includes a tilting motor 261, an elevating motor 262, and a rotational motor 263.

Referring to FIGS. 5 and 6, since the receptacle 220 is constructed so as to be moved in an up-and-down direction and to be rotated in horizontal and front and back directions, the direction in which drying air is discharged from the dryer 100 mounted on the receptacle 220 may be changed in an up-and-down direction and in a horizontal and/or front and back (anteroposterior) direction (see FIG. 4). By way of example, the receptacle 220 may be moved in an up-and-down direction by the power transmitted from the elevating motor 262 through a support 250 coupled to the receptacle 220 and a vertical rod 239 connected to the support 250.

The top of the support 250 may be covered with the ring-shaped upper cover 253. The vertical rod 239 may be positioned in a groove 237 that is lengthily formed up and down at the back of the upper side of the vertical plate 232 in such a way as to move up and down. An extension unit 233 may extend from an end on the upper side of the vertical plate 232 and then curve downward.

The support 250 may include a supporter body 251 rotatably coupled to the top of the vertical rod 239, and a guide supporter 252 fixed to the upper side of the supporter body 251 and received into the supporter body 251. Furthermore, the receptacle 220 may be rotated horizontally about a protrusion 251*b*, which is fitted into a hole formed in the vertical rod 239, by the power transmitted from the rotational motor 263 through the support 250. In addition, the receptacle 220 may be rotated (that is, tilted) in an anteroposterior direction by the power transmitted from the tilting motor 261 through tilting teeth 223*a* formed at a portion thereof.

The stem 230 may be provided with a rechargeable battery 291 for supplying power to the fans 283 and 284, the air purification unit 280, the light therapy unit 270, the elevating motor 262, the rotational motor 263 and the tilting motor 261. In this case, the battery 291 may be charged by external power applied through a docking station 294 coupled to the base 210.

The battery 291 may be detachably positioned in a hollow portion of the vertical plate 232. A controller 292 may be positioned at the rear of the battery 291. The controller 292 may control the operations of the light therapy unit 270 and the air purification unit 280. Furthermore, the controller 292 may control the operations of the receptacle rotation apparatus, the receptacle elevation apparatus, and the receptacle tilting apparatus in order to control the air discharge direction of the dryer 100. A hole 236 through which an electric wire passes may be formed over the hollow portion to electrically connect each of elements included in the stand 200.

The elevation apparatus may include the elevating motor 262, an elevation pinion 262*a* coupled to the rotation shaft of the elevating motor 262, and the vertical rod 239 movably positioned in the stem 230. In this case, an elevation rack 239*a* is formed on the side of the back of the vertical rod 239 and geared with the elevation pinion 262*a*.

The stand 200 according to an embodiment of the present disclosure includes a sensing apparatus S for detecting the position and size of an object to be dried. The sensing apparatus S may be an image photographing device, such as a camera, or a proximity sensor. The sensing apparatus S may detect the position and size of an object to be dried, which is positioned outside the stand 200.

The grip 120 and 130 may be provided with a pair of electrode terminals E11 and E12 (see FIG. 3B), and the receptacle 220 may be provided with a pair of electrode terminals E21 and E22, which respectively correspond to the pair of electrode terminals E11 and E12. As a result, when the grip 120 and 130 is mounted in the receptacle 220, the external power may be applied to the battery 80 of the dryer 100 through the electrode terminals, thereby charging the battery 80.

Furthermore, since a protruding rib 121 and magnets M11 and M12, which are provided at the grip 120 and 130, are respectively coupled to a fitting groove of the receptacle 220 and the magnets M21 and M22 which are provided at the receptacle 220, the grip 120 and 130 may be guided and secured to a predetermined position on the receptacle 220.

The present disclosure intends to provide the dryer 100 which is capable of controlling the discharge amount or a discharge rate of drying air in a stepwise manner, and, if desired, of diffusely discharging drying air to a region to be dried while minimizing the occurrence of overheating, noise or vibration due to operation of the fan 150. The dryer will now be described in more detail.

Hereinafter, the dryer according to the embodiment of the present disclosure will be described in more detail.

Figure 7:
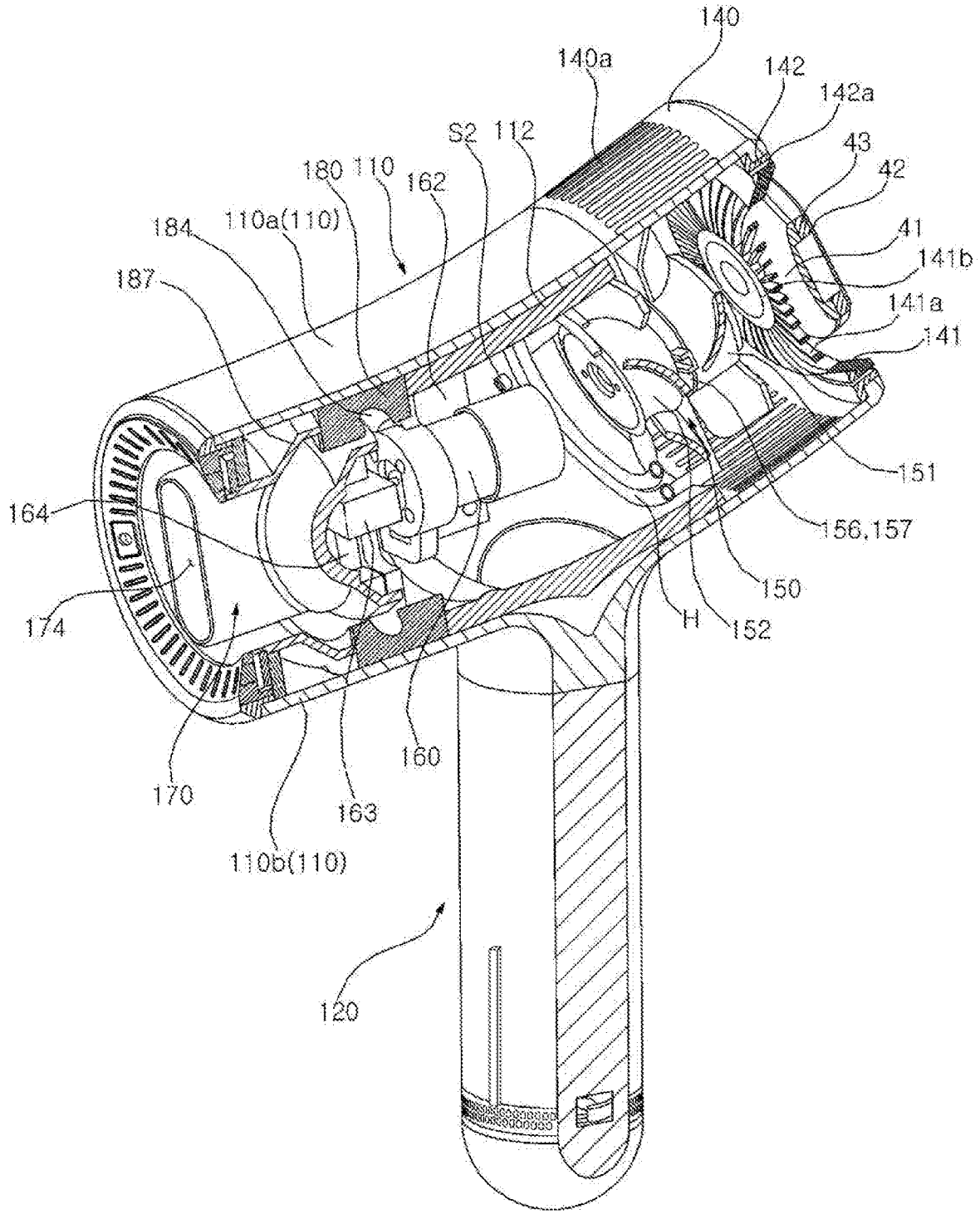
FIG. 7 is a cutaway perspective view illustrating the internal structure of the dryer according to the embodiment of the present disclosure.
Figure 8:
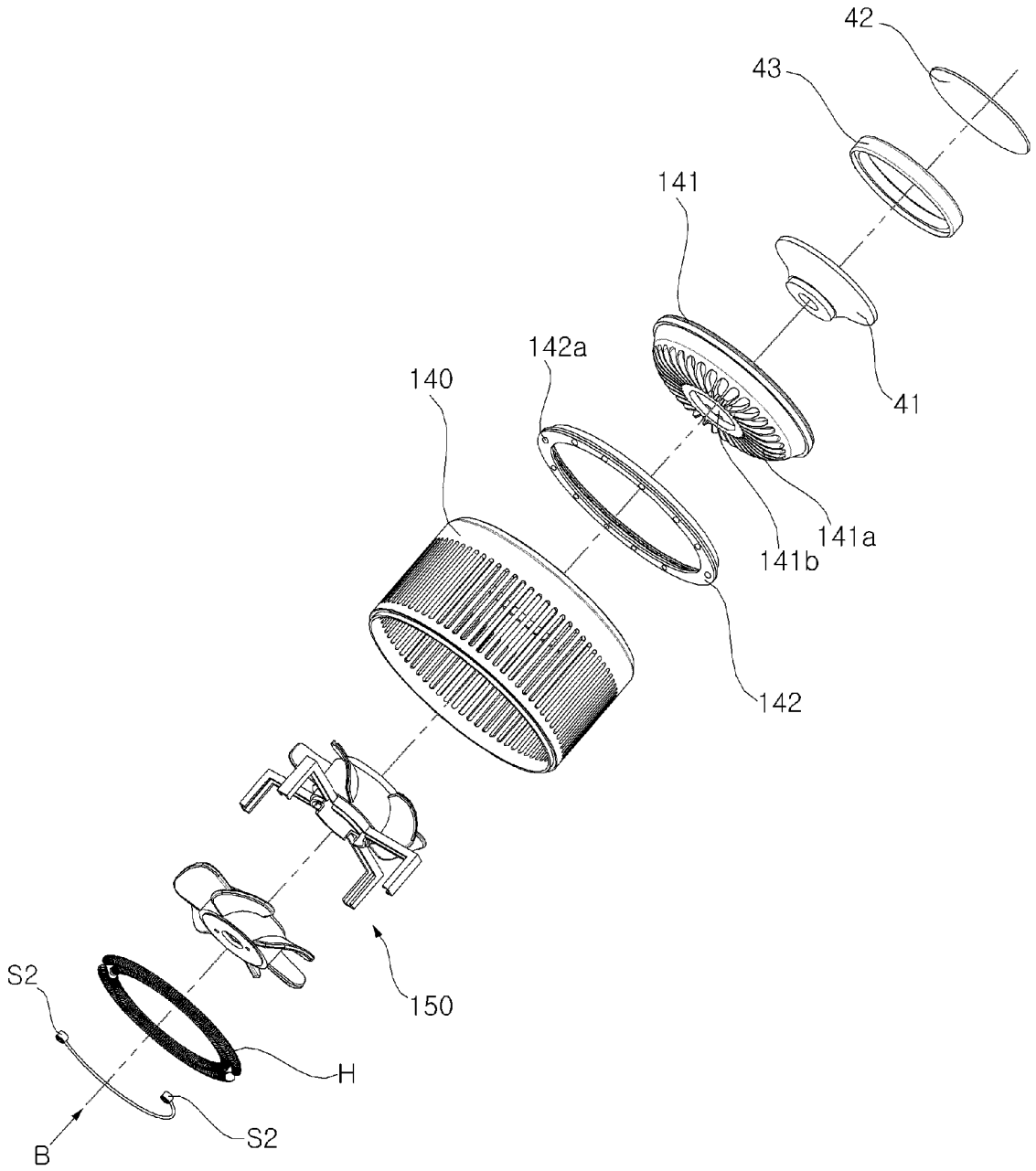
FIG. 8 is an exploded perspective view illustrating several components including the fan of the dryer according to the embodiment of the present disclosure.

FIG. 7 is a cutaway perspective view illustrating the internal structure of the dryer 100 according to the embodiment of the present disclosure. FIG. 8 is an exploded perspective view illustrating several components including the fan 150 of the dryer 100 according to the embodiment of the present disclosure.

Referring to FIGS. 7 and 8, the dryer 100 includes the hollow casing 110, the fan 150 disposed inside the casing 110, the heater H, and the discharge tube 170. The casing 110 may include a casing body composed of upper and lower casings 110*a* and 110*b*, which are integrally coupled to each other so as to define a cylindrical tube, a cylindrical rear cap 140 coupled to a rear portion of the casing body, and a rear cover 141 coupled to the rear end of the rear cap 140. Here, air may be introduced into the casing 110 through a plurality of through holes 140*a* formed in the rear cap 140 and a plurality of through holes 141*a* formed in the rear cover 141. According to the embodiment, a ring member 142 may be interposed between the rear cap 140 and the rear cover 141. Here, the air may be introduced into the casing 110 through a plurality of through holes 142*a* formed in the ring member 142.

The front part of the casing 110 may define an acute angle with respect to the grip 120 and 130, and the rear part of the casing 110 may define an obtuse angle with respect to the grip 120 and 130. Since the dryer 100, which is constructed in this way, advantageously discharges drying air downwards, it is possible to easily perform a drying operation on an object to be dried, which is usually positioned lower than the dryer, such as a child or a pet. Furthermore, it is possible to prevent foreign substances or water adhering to a user's hand gripping the grip 120 and 130 from being introduced into the casing 110 through the through holes 140*a* and 141*a*.

The fan 150 includes a first fan 151 and a second fan 152. Here, the rear cap 140 is disposed so as to surround the first fan 151, and the through holes 140*a* are formed in the side surface of the rear cap 140 that corresponds to the outer periphery of the first fan 151. Consequently, air may be more easily introduced into the first fan 151 through the through holes 140*a*.

The heater H may be positioned downstream of the fan 150 so as to heat the air that has passed through the fan 150. A temperature sensor S2 may be positioned downstream of the heater H so as to detect the temperature of the air that has passed through the heater H. By way of example, the dryer 100 may include a controller 90, which controls the operation of the heater H such that the temperature of the air that is detected by the temperature sensor S2 does not exceed a reference temperature.

According to the embodiment, an opening 141*b*, which is formed in the center of the rear cover 141, may be provided with a display unit 40. Here, the display unit 40 may include a base 41 fitted into the opening 141*b*, a display panel 42, which is coupled to the rear end of the base 41 and which displays various information, and a decoration ring 43, which serves to connect the base 41 to the display panel 42. Here, the information displayed on the display panel 42 may include the temperature of drying air, a discharge amount of air, the discharge rate of air, the drying time period, the temperature of a dried region of an object to be dried, and the like.

Figure 9:
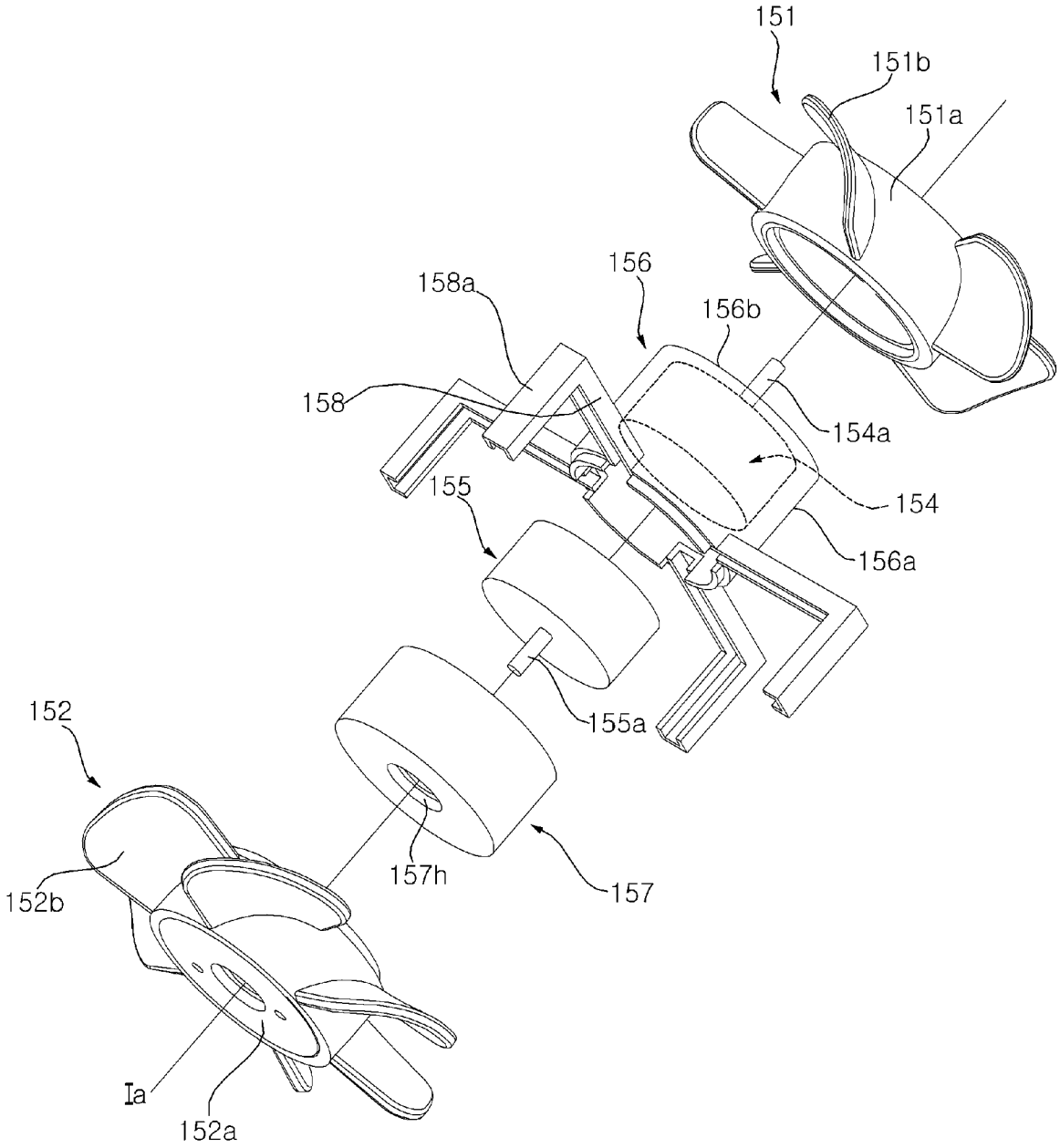
FIG. 9 is an exploded perspective view of the fan provided in the dryer according to the embodiment of the present disclosure.
Figure 10:
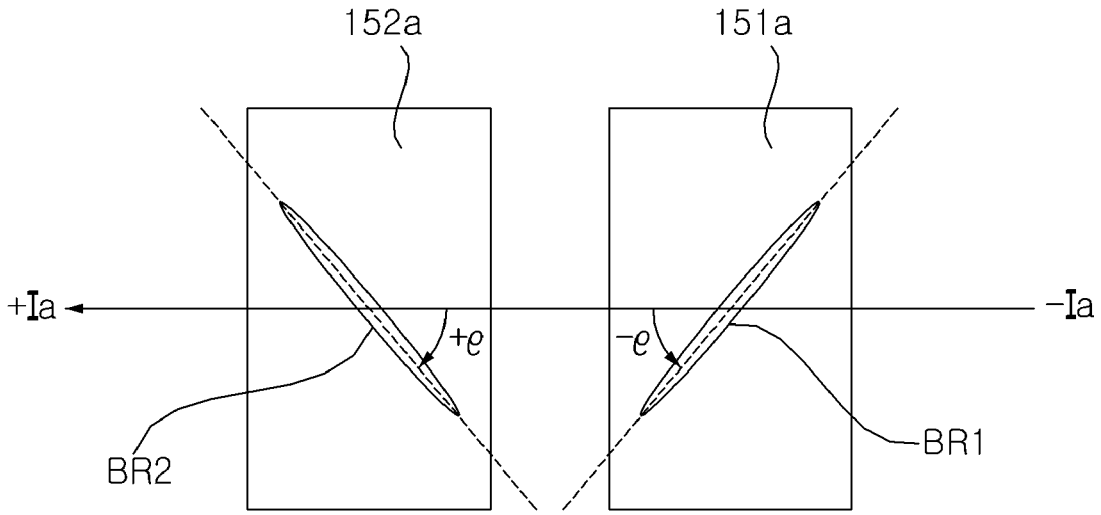
FIG. 10 is a view illustrating the blade roots of the fan provided in the dryer according to the embodiment of the present disclosure.

FIG. 9 is an exploded perspective view of the fan 150 provided in the dryer 100 according to the embodiment of the present disclosure. FIG. 10 is a view illustrating blade roots of the fan 150 provided in the dryer 100 according to the embodiment of the present disclosure.

Figure 11:
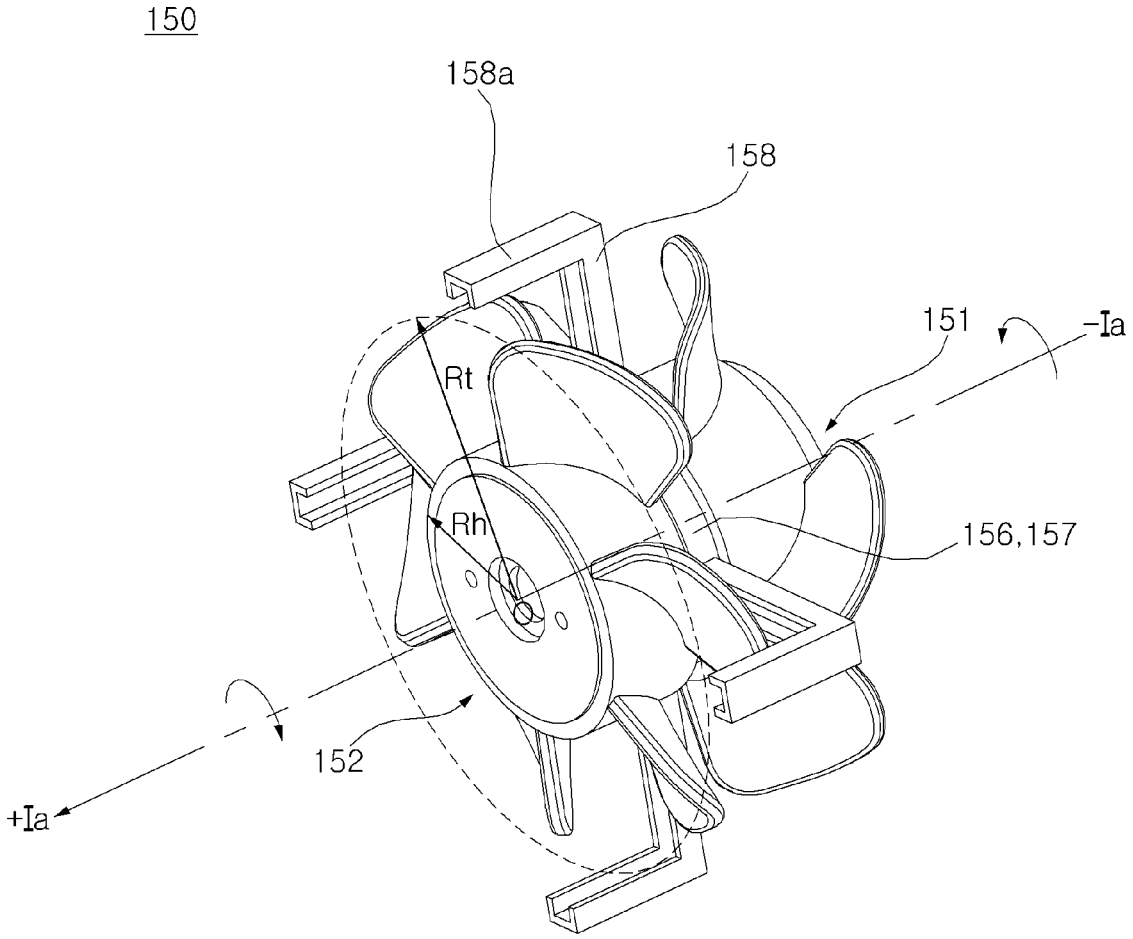
FIG. 11 is a perspective view of the fan, which is provided in the dryer according to the embodiment of the present disclosure.

Referring to FIG. 9, the first fan 151 and the second fan 152 may be rotatable about an imaginary axis, which is shared by the first and second fans 151 and 152, and may rotate in opposite directions (see FIG. 11). Each of the first and second fans 151 and 152 may be an axial flow fan.

In the following disclosure, the first and second fans 151 and 152 are described as being rotated in opposite directions by power supplied from separate fan motors. However, alternatively, the first and second fans 151 and 152 may be rotated in opposite directions by power from a single fan motor. For example, the rotating shaft of the single fan motor may be inserted into a hollow shaft, and the rotating shaft and the hollow shaft may be connected to each other via a gear train so as to be rotated in opposite directions. In other words, the first fan 151 may be connected to the rotating shaft and the second fan 152 may be connected to the hollow shaft such that the first and second fans 151 and 152 are rotated in opposite directions upon activation of the single fan motor.

In the dryer according to the embodiment of the present disclosure using separate fan motors, the dryer 100 may include the controller 90 and two touch buttons 93*a* and 93*b* for controlling the on/off operation and rotational speed of individual first and second fans 151 and 152. A button case 92 and a button housing 91 may be used to secure the buttons. The fan motors, which are respectively provided to drive the first and second fans 151 and 152, may be brushless direct current motors (BLDCs) capable of controlling the rotational speed thereof. Accordingly, the controller 90 is able to control the discharge amount or discharge rate of drying air in a stepwise manner by controlling an on/off operation and a rotational speed of the individual first and second fans 151 and 152.

Each of the first and second fans 151 and 152 may include a fan motor, a hub and a plurality of blades. The fan motor 154 (hereinafter, referred to as a "first fan motor") of the first fan 151 may include a rotating shaft 154*a* (hereinafter, referred to as a "first rotating shaft"), which extends along the imaginary axis Ia. The fan motor 155 (hereinafter, referred to as a "second fan motor") of the second fan 152 may also include a rotating shaft 155*a* (hereinafter, referred to as a "second rotating shaft"), which extends along the imaginary axis Ia. The first rotating shaft 154*a* may be connected to the hub 151*a* (hereinafter, referred to as a "first hub") of the first fan 151. The second rotating shaft 155*a* may also be connected to the hub 152*a* (hereinafter, referred to as a "second hub") of the second fan 152. The blades 151*b* (hereinafter, referred to as "first blades") of the first fan 151 may be coupled at first ends thereof to the outer peripheral surface of the first hub 151*a* and may be provided at second ends thereof with tips. The blades 152*b* (hereinafter, referred to as "second blades") of the second fan 152 may be coupled at first ends thereof to the outer peripheral surface of the hub 152*a* and may be provided at second ends thereof with tips.

The fan 150 may include a fan mount 156 and 157, which receives the first and second fan motors 154 and 155. The fan mount 156 may include a mount body 156*a* and a mount cover 156*b* coupled to the mount body 156*a*. By way of example, the first fan motor 154 may be inserted into the mount body 156*a* through an opening formed in the front face of the mount body 156*a*, and the second fan motor 155 may be inserted into a mount cover of the fan mount 157 through an opening formed in the rear face of the mount cover of the fan mount 157. Here, the first rotating shaft 154*a* may be connected to the first hub 151*a* through a shaft hole formed in the rear face of the mount cover 156*b*, and the second rotating shaft 155*a* may be connected to the second hub 152*a* through a shaft hole 157*h* formed in the front face of the mount cover of fan mount 157.

In terms of the flow of air from the upstream direction of the fan to the downstream direction thereof, which is caused by the fan 150, the above description may be disclosed as follows. That is, the first fan motor 154 may be received in the first hub 151*a*, and the first rotating shaft 154*a*, which extends in an upstream direction from the first fan motor 154, may be connected to the first hub 151*a*. Furthermore, the second fan motor 155 may be received in the second hub 152*a*, and the second rotating shaft 155*a*, which extends in a downstream direction from the second fan motor 155, may be connected to the second hub 152*a*.

Referring to FIGS. 9 and 10, the first fan 151 may be positioned upstream of the second fan 152. Although the first and second fans 151 and 152 rotate in opposite directions about the imaginary axis la, both the first and second fans 151 and 152 cause air to flow from the rear side to the front side.

Specifically, assuming that a viewer views the fan 150 from the downstream side of the fan 150 looking toward the upstream side of the fan, when the first fan 151 is rotated in a counterclockwise direction (i.e., in a rotational direction based on the direction of +Ia) while the second fan 152 is rotated in a clockwise direction (i.e., in a rotational direction based on a direction of −Ia) (see FIG. 11), both the first and second fans 151 and 152 may cause air to flow from the rear side toward the front side.

To this end, the blade root BR1 of the first fan 151 (hereinafter, referred to as a "first blade root") and the blade root BR2 of the second fan 152 (hereinafter, referred to as a "second blade root") may be configured so as to be inclined in opposite directions with respect to the imaginary axis Ia. Here, the blade root is a portion at which the hub and the blade are connected to each other, and also is referred to as a "blade base". In other words, the first blade root BR1 may be formed by coupling the first blade 151*b* to the outer peripheral surface of the first hub 151*a*, and the second blade root BR2 may be formed by coupling the second blade 152*b* to the outer peripheral surface of the second hub 152*a*.

Since the first blade root BR1 is inclined in the direction of −ρ with respect to the imaginary axis Ia, whereas the second blade root BR2 is inclined in the direction of +ρ with respect to the imaginary axis Ia, both the first and second fans 151 and 152 may cause air to flow in the direction of +Ia even when the first and second fans 151 and 152 are rotated in opposite directions.

In terms of the downstream flow of air from the upstream side of the fan 150, the above configuration may be described as follows. Specifically, when the first fan 151 is rotated in a first direction, the end of the first blade root BR1 in the first direction may be positioned further upstream than the end of the first blade root BR1 in the direction opposite the first direction. When the second fan 152 is rotated in the second direction, opposite the first direction, the end of the blade root BR2 may be positioned further upstream than the end of the second blade root BR2 in the direction opposite the second direction.

Air that passes through the first fan 151 includes a circumferential component velocity. Because the circumferential component velocity not only deteriorates the straightness of output air but also creates a vortex, thereby disturbing flow of air, the circumferential component velocity becomes a cause decreasing the efficiency or performance. In contrast, according to the present disclosure, since the circumferential component velocity of air that has passed through the first fan 151 may be reduced while the air passes through the second fan 152, there is an advantage of enhancing the straightness of air passing through the second fan 152.

FIG. 11 is a perspective view of the fan 150 provided in the dryer 100 according to the embodiment of the present disclosure.

Referring to FIG. 11, the number of second blades 152*b* may be larger than the number of first blades 151*b*. By way of example, the number of second blades 152*b* may be six, and the number of first blades 151*b* may be five. However, the numbers of the blades and the difference between the numbers of first and second blades 151*b* and 152*b* are not limited thereto. When the number of blades is relatively large, air is finely split and blown, and it may thus be advantageous for blowing mild wind. In contrast, when the number of blades is relatively small, it is possible to blow relatively strong wind.

In other words, since the first fan 151, which has a relatively small number of blades, is positioned upstream of the second fan 152, it is possible to increase the intake amount of air. Furthermore, since the second fan 152, which has a relatively large number of blades, is positioned downstream of the first fan 151, it is advantageous in discharging milder wind. Particularly, the strong air that is blown by the first fan 151 may create strong and mild airflow while passing through the second fan 152. In this regard, it is understood that the first fan 151 is intended to fulfill the intake of air and the second fan 152 is intended to fulfill the discharge of air.

Referring to FIG. 11, the hub radii Rh of the first and second blades 151*b* and 152*b* may be the same as each other, and the tip radii Rt of the first and second blades 151*b* and 152*b* may be the same as each other. Here, the hub radius Rh is the distance between the center of the hub and the outer periphery of the hub, and the tip radius Rt is the distance between the center of the hub and the tip of the blade. In this way, since the hub radii Rh of the first and second fans 151 and 152 are the same as each other, and the tip radii Rt of the first and second fans 151 and 152 are the same as each other, it is possible to prevent an undesirable vortex from being created in the airflow passing through the first and second fans 151 and 152.

Figure 12:
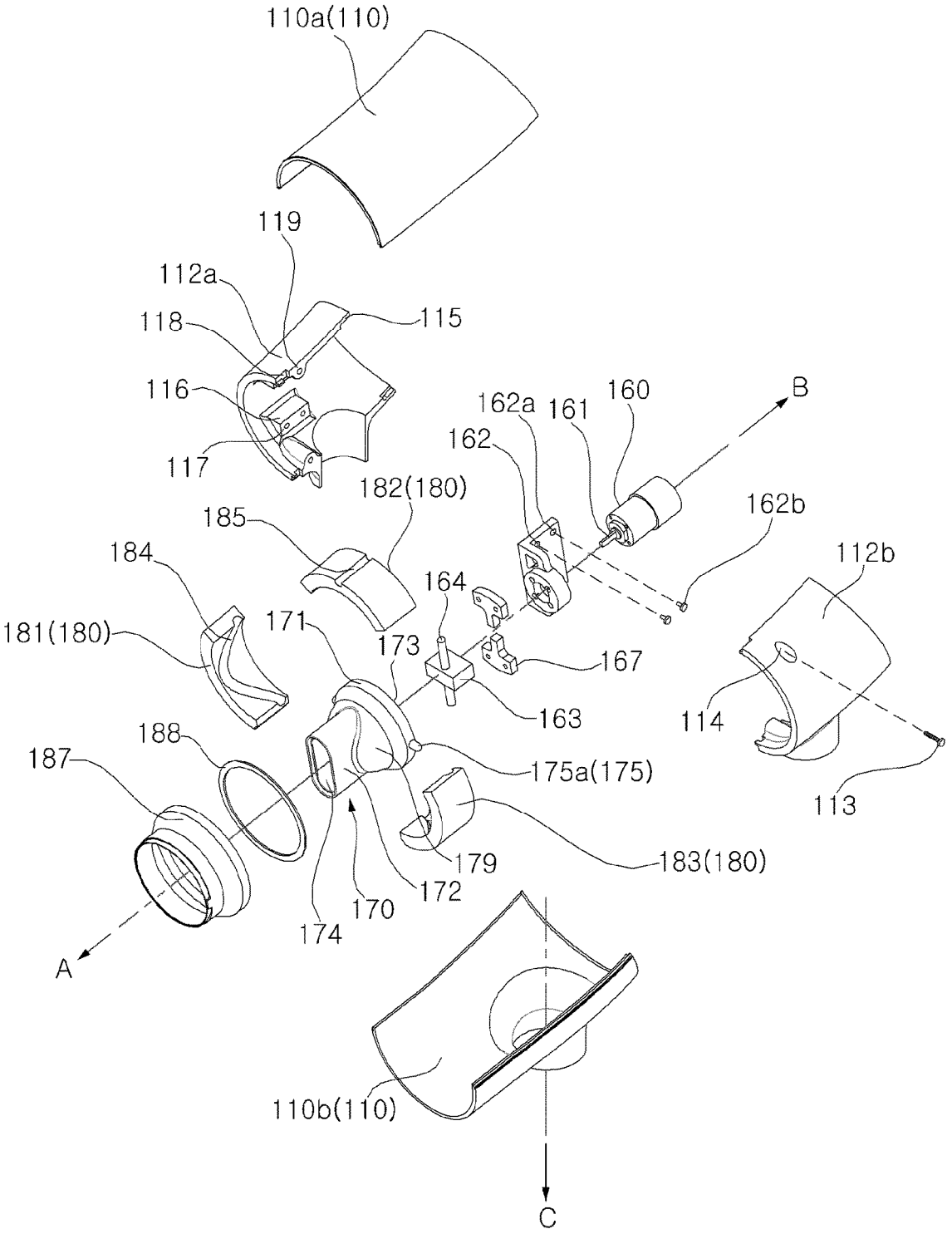
FIG. 12 is an exploded perspective view illustrating several of the components, including the discharge tube, according to the embodiment of the present disclosure.

FIG. 12 is an exploded perspective view illustrating some of the components, including the discharge tube 170, according to the embodiment of the present disclosure.

Referring to FIG. 12, the discharge tube 170 may be provided at one side thereof (i.e., the upstream side thereof) with an inlet 173, into which the air that has passed through the fan 150 and the heater H is introduced, and may be provided at the other side thereof (i.e., the downstream side thereof) with an outlet 174, from which the air that is introduced into the inlet 173 is discharged.

The rear part of the discharge tube 170 may be configured to have a cylindrical part 171, and the front part of the discharge tube 170 may be configured to have a pipe portion 172. The intermediate part between the front part and the rear part may be configured to have a skirt portion 179, which is gradually reduced in transverse cross sectional area moving forwards, thereby defining a funnel shape overall. Here, the cylindrical part 171 may be provided at an upstream side thereof with a circular inlet 173, and the pipe portion 172 may be provided at a downstream side thereof with an outlet 174 having an oblong shape.

The outlet 174 may be configured to have a size smaller than the size of the inlet 173. The outlet 174 may be configured such that one of a horizontal length and a vertical length thereof is longer than the other. By way of example, the outlet 174 may be configured to have an oblong shape. Here, the oblong shape may be considered to have a shape that includes not only a simple rectangular shape but also shapes such as a race-track shape (obround) and an elliptical shape, in which lengths in directions orthogonal to each other are different from each other. Accordingly, air, which is introduced into the inlet 173, may be intensively discharged through the outlet 174 toward an object to be dried.

According to the embodiment, the discharge tube 170 may be provided therein with a partition plate 178 (see FIG. 2). The partition plate 178 partitions the flow path of air, which passes through the discharge tube 170, such that the air introduced into the inlet 173 is divided in predetermined directions and is discharged to the outside through the outlet 174. The partition plate 178 may be configured to have not only a flat plate shape but also a bent shape such as a "V" shape. Furthermore, the partition plate 178 may be designed so as to smoothly swing within a predetermined angular range according to the flow of air passing through the discharge tube 170.

According to the embodiment, the dryer 100 may include a discharge cover 187 and a sealing member 188. The discharge cover 187 may be disposed between the front portions of the upper and lower casings 110*a* and 110*b* and the discharge tube 170, and may be configured to have a circular shape so as to receive therein a portion of the discharge tube 170. The rear end of the discharge cover 187 may be coupled to a guide 180, to be described later, so as to be fixed at a predetermined position. The sealing member 188 may be disposed between the rear end of the discharge cover 187 and the discharge tube 170 and may be configured to have a circular shape so as to prevent air blown by the fan 150, from being discharged to the outside through the clearance between the discharge tube 170 and the discharge cover 187.

In the present disclosure, the discharge tube 170 is provided in the casing 110 so as to rotate at least in one direction. Accordingly, converging wind, in which drying air is intensively discharged through the outlet 174 to a region to be dried may be realized when the discharge tube 170 is not rotated, and diffusing wind, in which drying air is diffusely discharged through the outlet 174 to a wider region to be dried, may be realized when the discharge tube 170 is rotated.

To this end, the dryer 100 may include the guide 180, having a cylindrical shape, which is disposed in the upper and lower casings 110*a* and 110*b*. The guide 180 includes a groove 184 formed in the inner peripheral surface thereof. The guide 180 may be composed of first to third guides 181, 182 and 183, which are coupled to one another so as to define a cylindrical form. However, the guide 180 is not limited thereto, and may also be initially configured to have an integral cylindrical form. The guide 180 may be coupled at the rear end thereof to the front end of an inner sleeve 112, to be described later, so as to be fixed at a predetermined position.

Furthermore, the discharge tube 170 may include a protrusion 175, which is formed on the outer peripheral surface thereof and which is disposed in the groove 184 and is slidably moved along the groove 184. In other words, the discharge tube 170 may be rotated in a predetermined direction by virtue of movement of the protrusion 175 along the groove 184. The protrusion 175 may be protruded radially outwards from the cylindrical part 171. The protrusion 175 may include a pair of protrusions 175*a* and 175*b*, which are spaced apart from each other by an angle of 180 degrees in a circumferential direction. Here, the circumferential direction of the cylindrical part 171 is the direction corresponding to the circumferential direction of the guide 180. Although the case in which the number of protrusions 175, which move along the groove 184, is two is more advantageous than the case in which the number of protrusions 175 is one, the present disclosure is not limited thereto. In some embodiments, in place of the protrusions 175, balls or rollers may also be moved along the groove 184.

The groove 184 may form a closed curve in the inner peripheral surface of the guide 180 such that the groove 184 continuously guides the sliding movement of the protrusions 175. The groove 184 may be formed in the inner peripheral surface of the guide 180 so as to define various shapes.

Figure 13:
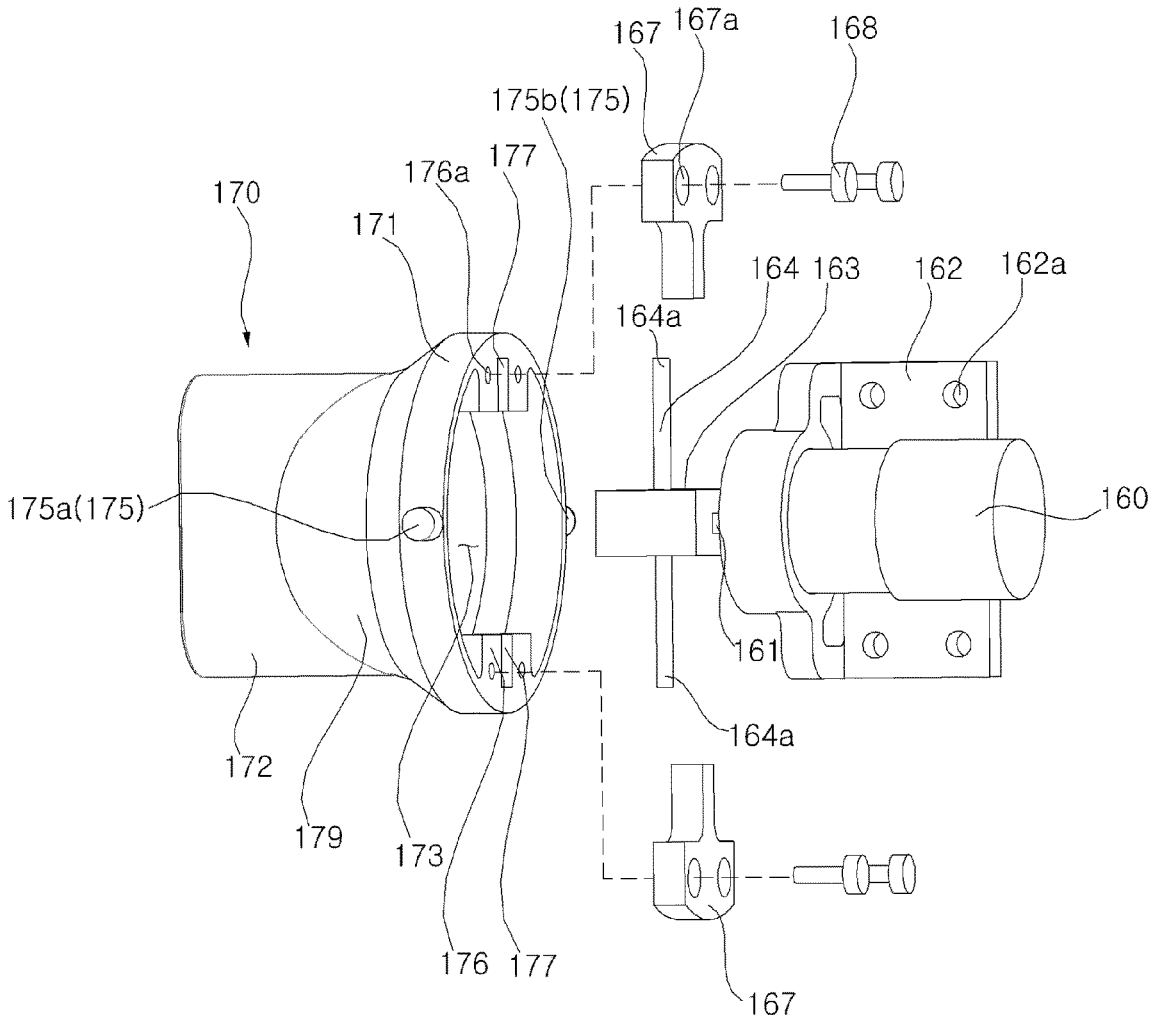
FIG. 13 is an exploded perspective view illustrating the discharge tube and the rotation motor, which are provided in the dryer according to the embodiment of the present disclosure.
Figure 14:
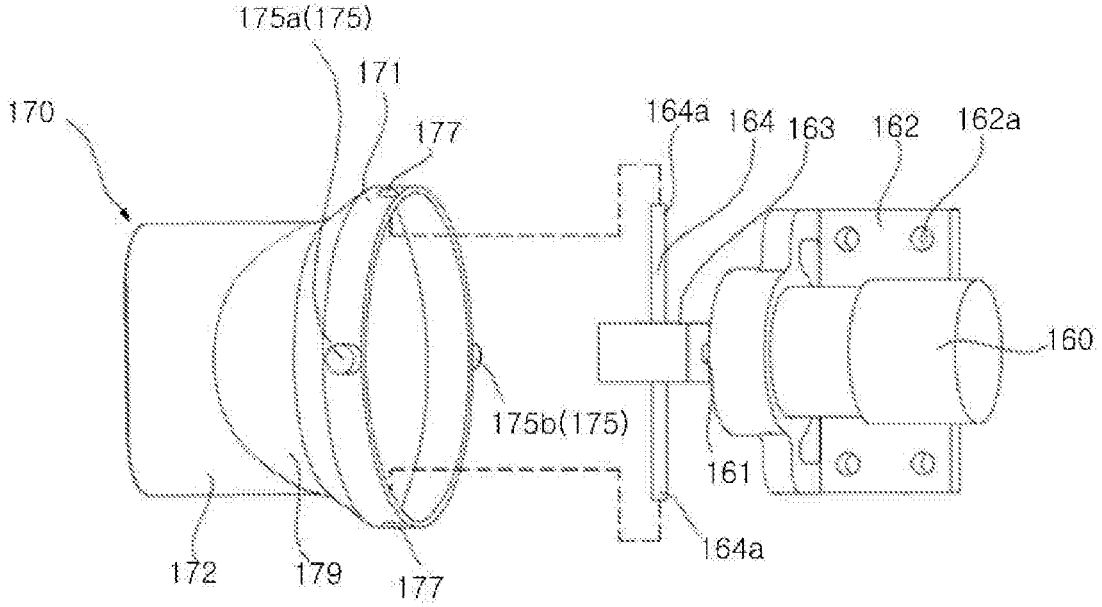
FIG. 14 is an exploded perspective view illustrating the discharge tube and the rotation motor, which are provided in a dryer according to another embodiment of the present disclosure.
Figure 15:
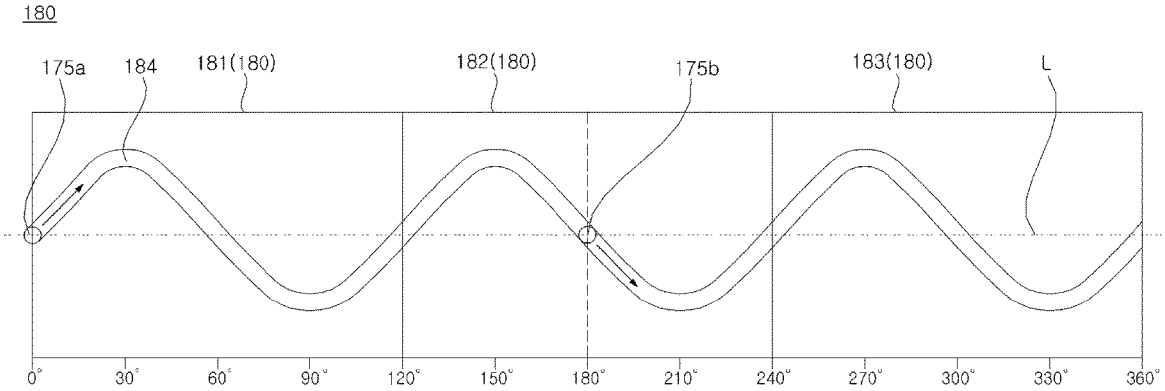
FIG. 15 is a development view illustrating the inner surface of the guide provided in the dryer according to the embodiment of the present disclosure.
Figure 16:
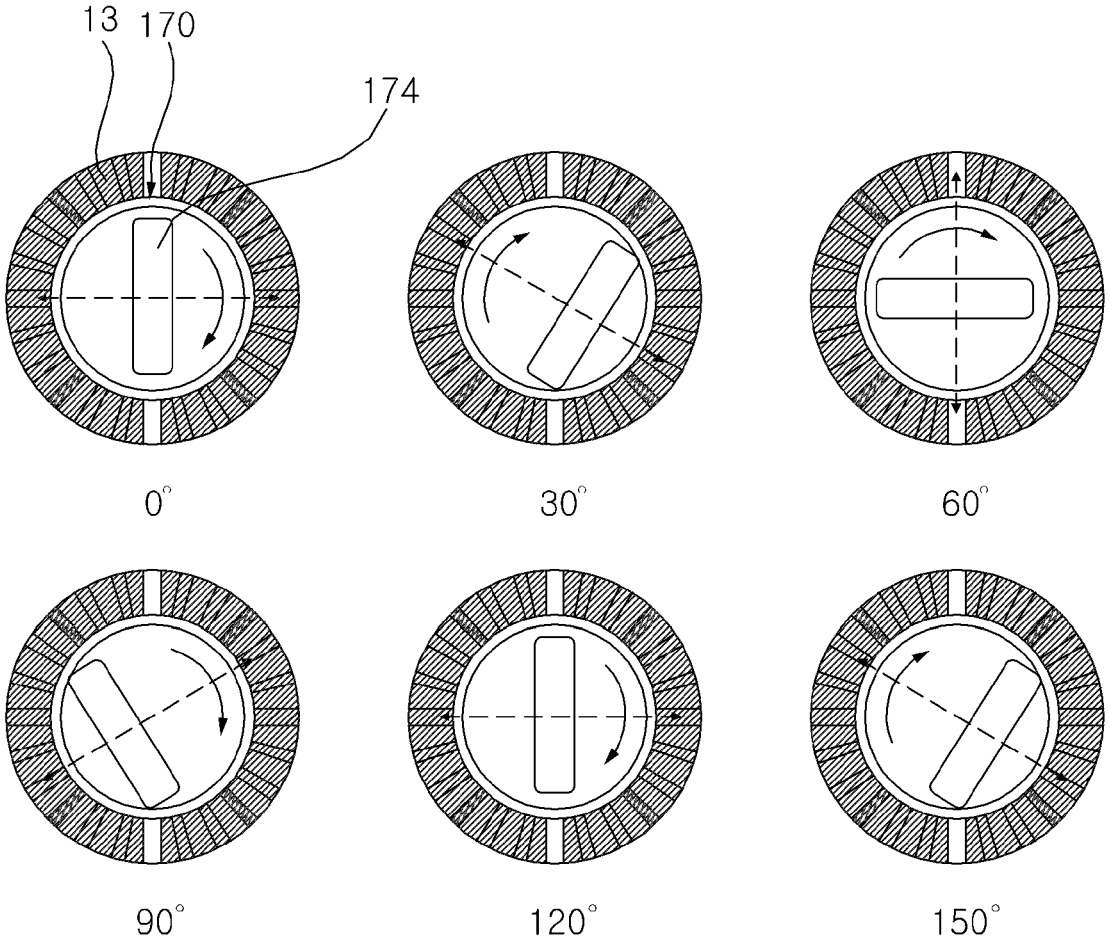
FIG. 16 is a view illustrating rotational stages of the discharge tube provided in the dryer according to the embodiment of the present disclosure.

FIG. 13 is an exploded perspective view illustrating the discharge tube 170 and the rotation motor 160, which are provided in the dryer 100 according to the embodiment of the present disclosure. FIG. 14 is an exploded perspective view illustrating the discharge tube 170 and the rotation motor 160, which are provided in a dryer 100 according to another embodiment of the present disclosure. FIG. 15 is a development view illustrating the inner surface of the guide 180 provided in the dryer 100 according to the embodiment of the present disclosure. FIG. 16 is a view illustrating rotational stages of the discharge tube 170 provided in the dryer 100 according to the embodiment of the present disclosure.

Referring to FIGS. 12 and 13, although the discharge tube 170 may be manually rotated by a user, the discharge tube 170 may also be automatically rotated in response to a predetermined control signal. To this end, the dryer 100 may include the rotation motor 160, which is electrically activated, and a connector 164. Here, the connector 164 may be connected at one end thereof to the rotating shaft 161 of the rotation motor 160 and at the other end thereof to the discharge tube 170 so as to transmit the power generated by the rotation motor 160 to the discharge tube 170.

The connector 164 may be connected to the rotating shaft 161 of the rotation motor 160 via a link block 163. Accordingly, since the rotating shaft 161 is fixed to the link block 163 and the connector 164 is fitted into the link block 163, the connector 164 may rotate in the rotational direction of the rotating shaft 161 upon activation of the rotation motor 160. In some embodiments, the connector 164 may be directly connected to the rotating shaft 161.

Both ends 164*a* of the connector 164 may be connected to the discharge tube 170. To this end, the discharge tube 170 may include a pair of recess portions 177, which are angularly spaced apart from each other by 180 degrees in a direction corresponding to the rotational direction of the rotating shaft 161. Here, the recess portions 177 may be formed in the inner peripheral surface of the cylindrical part 171, and the rotational direction of the rotating shaft 161 is a direction corresponding to the circumferential direction of the cylindrical part 171.

An embodiment of the present disclosure will be described with reference to FIG. 13. The recess portions 177 may be formed in inward blocks 176, which project inwards from the inner peripheral surface of the cylindrical part 171. Here, it is possible to prevent the connector 164 from being separated from the recess portions 177 by fitting both ends 164*a* of the connector 164 into the pair of recess portions 177 and then coupling a pair of stoppers 167 to the inward blocks 176. By way of example, a plurality of coupling holes 167*a* and 176*a* may be formed in the stoppers 167 and the inward blocks 176 in an alignment manner, and screws 168 may be engaged with the coupling holes 167*a* and 176*a*, with the result that the stoppers 167 and the inward blocks 176 are coupled to each other.

Another embodiment of the present disclosure will be described with reference to FIG. 14. The recess portions 177 may be formed by depressing portions of the inner peripheral surface of the cylindrical part 171 in a radially outward direction, or by apertures located in the cylindrical part 171 in a radially outward direction. Here, since both ends 164*a* of the connector 164 are inserted into the pair of recess portions 177, it is possible to prevent the connector 164 from being separated from the recess portions 177 without using additional components such as the stoppers 167.

In the above-mentioned embodiments, the connector 164 may extend in a direction orthogonal to the rotating shaft 161, and both ends of the connector 164 may be rotatably fitted into the recess portions 177. Consequently, when the rotation motor 160 is activated, the discharge tube 170 may rotate about both the rotating shaft 161 and the longitudinal axis of the connector 164.

In other words, the rotational orbit of the discharge tube 170 may be determined by the protrusions 175, which are fitted into the groove 184 and moved therealong, and the rotational motion of the discharge tube 170 may be performed by the connector 164, which transmits the power from the rotation motor 160, fitted into the recess portions 177. When the connector 164, which is rotatably fitted into the recess portions 177, applies force to the recess portions 177 in the rotational direction of the rotating shaft 161, the protrusions 175 of the discharge tube 170 may be automatically moved along the groove 184, which may define a predetermined a wave shape.

Referring to FIG. 15, the groove 184 may define a predetermined wave shape in the circumferential direction of the guide 180. By way of example, the wave shape may lead to the third guide 183 from the first guide 181, and may exhibit a phase angle ranging from 0 degrees, serving as a reference point, to 360 degrees. The wave shape may be configured such that the wave period of the wave shape is 120 degrees and the wave shape is symmetrical in forward and reverse directions with respect to the central reference line L at an interval of 180 degrees. In other words, the wave shape may define a sinusoidal wave.

Referring to FIGS. 15 and 16, the pair of protrusions 175*a* and 175*b* are positioned at angles of 0 degrees and 180 degrees in the groove 184, the protrusions 175 are positioned at the same level, that is, the reference line L, and the outlet 174 is thus vertically positioned at the center (see an angle of 0 degree in FIG. 16).

When the rotation motor 160 is activated, the pair of protrusions 175*a* and 175*b* may slidably move in the direction indicated by the arrow in FIG. 15, and the protrusions 175 may be moved in opposite directions with respect to the reference line L. In other words, when rotated by an angle of 30 degrees, the pair of protrusions 175*a* and 175*b* are positioned at the farthest positions from the reference line L in opposite directions, with the result that the outlet 174 is positioned at a lower right point (see an angle of 30 degrees in FIG. 16).

When subsequently rotated by an angle of 60 degrees, the pair of protrusions 175*a* and 175*b* are positioned at the reference line L again, with the result that the outlet 174 is horizontally positioned at the center (see the angle of 60 degrees in FIG. 16). When subsequently rotated by an angle of 90 degrees, the pair of protrusions 175*a* and 175*b* are positioned at the farthest positions from the reference line L in opposite directions, with the result that the outlet 174 is positioned at a lower left point (see the angle of 90 degrees in FIG. 16). When subsequently rotated by an angle of 120 degrees, the pair of protrusions 175*a* and 175*b* are positioned at the reference line L again, with the result that the outlet 174 is vertically positioned at the center (see the angle of 120 degrees in FIG. 16). Thereafter, the above procedure is repeated.

In other words, when the groove 184 defines a predetermined wave shape, the protrusions 175 or the discharge tube 170 may be rotated about the longitudinal axis of the connector 164 orthogonal to the rotating shaft 161 while being rotated about the rotating shaft 161. As a result, the rotational motion of the discharge tube 170 is diversified, and drying air is diffusely discharged to a wider region to be dried, compared to the case in which the discharge tube is rotated only about a single axis.

According to the embodiment, when the temperature of a region of an object to be dried, which is detected by an external temperature sensor S1 (see FIGS. 2 and 3A), is higher than a reference temperature, the controller 90 may drive the rotation motor 160. Consequently, in addition to selection of converging wind and diffusing wind through input by a user, it is possible to automatically convert a discharge manner from the converging wind into the diffusing wind in order to prevent a region to be dried from being excessively overheated. Furthermore, the controller 90 is also able to control the rotational intensity of airflow discharged through the discharge tube 170 by controlling the rotational speed of the rotation motor 160. To this end, the rotation motor 160 may be a brushless direct current motor (BLDC), the rotational speed of which is able to be controlled.

Figure 17:
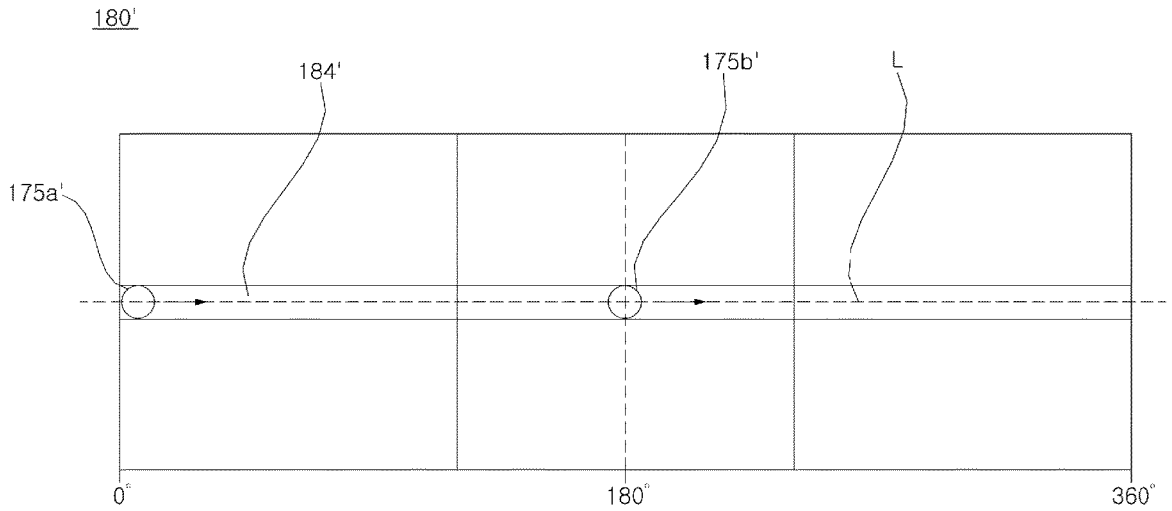
FIG. 17 is a development view illustrating the inner surface of a guide provided in a dryer according to a further embodiment of the present disclosure.
Figure 18:
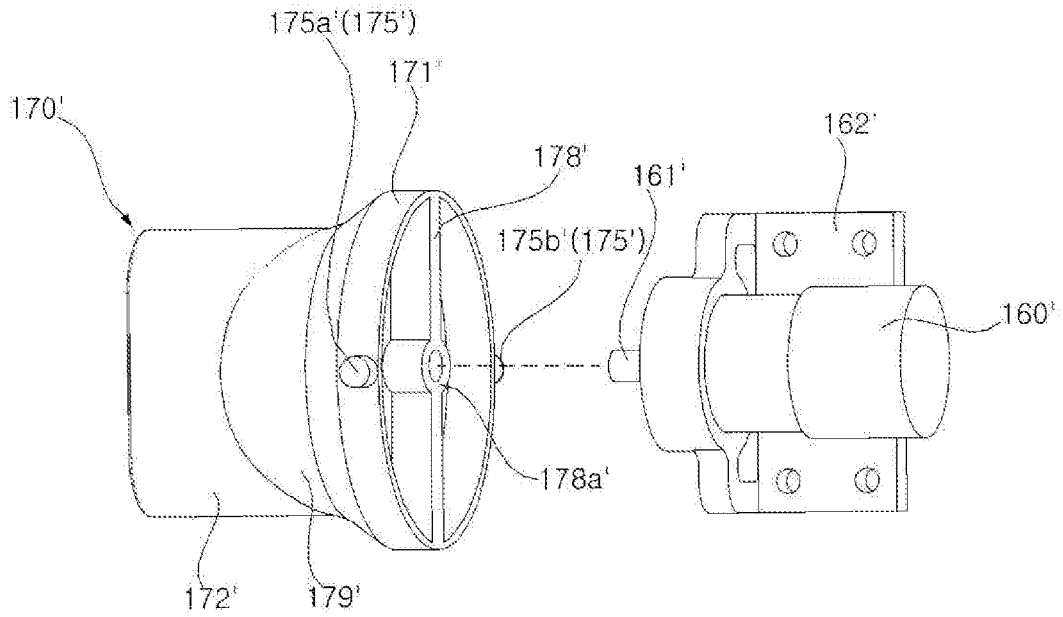
FIG. 18 is an exploded perspective view illustrating a discharge tube and a rotation motor, which are provided in a dryer according to a further embodiment of the present disclosure.

FIG. 17 is a development view illustrating the inner surface of a guide 180' provided in a dryer 100 according to a further embodiment of the present disclosure. FIG. 18 is an exploded perspective view illustrating a discharge tube 170' and a rotation motor 160, which are provided in a dryer 100 according to a further embodiment of the present disclosure.

A further embodiment of the present disclosure will be described with reference to FIG. 17. A groove 184' may be formed in a circular shape in the inner surface of the guide 180' in the circumferential direction of the guide 180'. In this case, a pair of protrusions 175*a*' and 175*b*' may move along the groove 184' in one direction (or in the opposite direction).

Referring to FIG. 18, since the rotational orbit of the protrusions 175' corresponds to the circular shape defined by the grooves 184', a discharge tube 170' may be rotated about a rotating shaft 161'. In this case, the structures of the discharge tube 170 and the connector 164, which were described with reference to FIG. 13 or 14, may be applied. However, because the rotational direction of the discharge tube 170' is limited to the rotational direction of the rotating shaft 161', it is sufficient to consider only connection of the rotating shaft 161' to the discharge tube 170' without having to consider an additional shaft serving as the rotational center of the discharge tube 170'. In other words, the rotating shaft 161' may be coupled to a coupling hole 178*a*' formed in the center of a plate member 178' coupled to the inner surface of the cylindrical part 171'. Consequently, since the power from the rotation motor 160' fitted into a motor mount 162' is transmitted to the discharge tube 170' via the plate member 178', the discharge tube 170' may be rotated along a circular orbit. The plate member 178' may also serve as the partition plate 178. The front part of the discharge tube 170' may be configured to have a pipe portion 172', and the rear part of the discharge tube 170' may be configured to have a skirt portion 179'.

Figure 19:
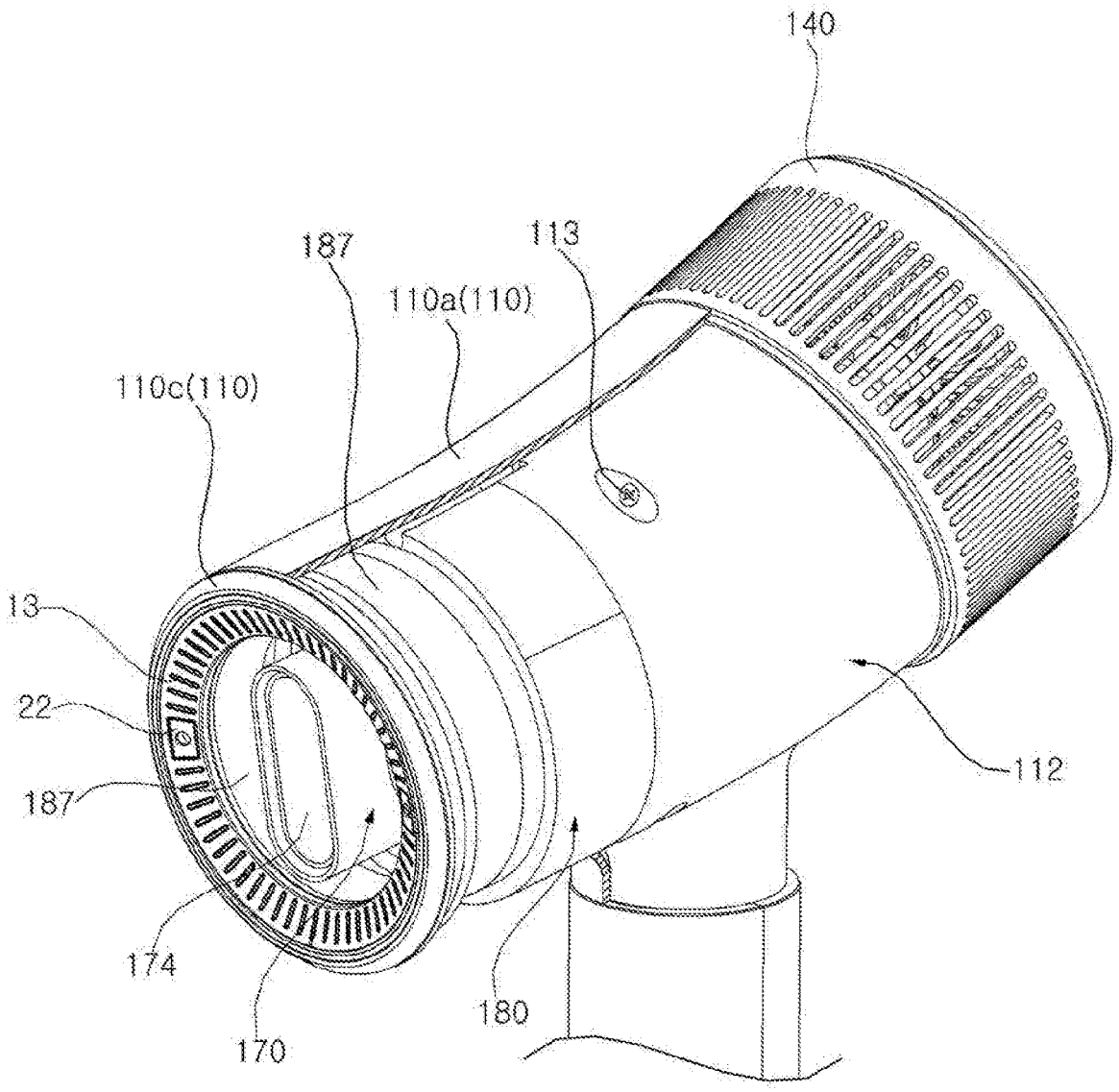
FIG. 19 is a perspective view of the dryer according to the embodiment of the present disclosure, in which the casing is partially broken away.

FIG. 19 is a perspective view of the dryer 100 according to the embodiment of the present disclosure, in which the casing is partially broken away.

Referring to FIGS. 12 and 19, the inner sleeve 112 may be disposed inside the upper and lower casings 110*a* and 110*b*. The outer peripheral surface of the inner sleeve 112 may be brought into close contact with the inner peripheral surface of the upper and lower casings 110*a* and 110*b*. Although the inner sleeve 112 may be composed of left and right inner sleeves 112*a* and 112*b*, which are coupled to each other, the inner sleeve 112 is not limited thereto, and may originally be integrally formed therewith. The left and right inner sleeves 112*a* and 112*b* may be coupled to each other by engaging a screw 113, which is inserted through a screw hole 114 formed in the right inner sleeve 112*b*, with a screw hole 119 formed in the left inner sleeve 112*a*.

The inner sleeve 112 may be provided with the rotation motor 160 and the fan 150. The rotation motor 160 may first be fitted into a motor mount 162, and the motor mount 162 may be fixed to the inner sleeve 112. By way of example, the motor mount 162 and the rotation motor 160 may be fixed in the inner sleeve 112 by engaging screws 162*b*, which are inserted through screw holes 162*a* formed in the motor mount 162, with screw holes 117 formed in a support block 116 of the left inner sleeve 112*a*.

The fan 150 may include the fan mount 156 and 157, and the fan mount 156 and 157 may be fixed to the inner sleeve 112. By way of example, the fan mount 156 and 157 may include a plurality of fixing rods 158, which project in a radial and outward direction and are fixed to the inner sleeve 112 (see FIG. 9). The rear portion of the inner sleeve 112 may be provided with a plurality of depressed grooves 115 corresponding to the plurality of fixing rods 158, which are circumferentially spaced apart from each other. Although the number of fixing rods 158 is not specifically limited thereto, the plurality of fixing rods 158 are symmetrically configured, and the fan 150 is thus stably fixed to the inner sleeve 112.

The fan mount 156 and 157 of the fan 150 may be fixed to the inner sleeve 112 by the plurality of fixing rods 158 fitted into the plurality of depressed grooves 115. The fixing rods 158 may be configured such that the outer ends 158*a* thereof are bent forwards and are fitted into the depressed grooves 115.

Each of the fixing rods 158 may be bent at least once in a transverse direction so as to have a "U"-shaped or "C"-shaped cross-section. As a result, the rigidity of the fixing rods 158 may be improved, and various electric wires may be received in the "U"-shaped or "C"-shaped grooves, thereby facilitating management of the electric wires.

Cables, which electrically connect various electronic components provided in the dryer 100 to each other, may pass through a cable hole 118 formed in the upper portion of the inner sleeve 112 and through a cable groove 185 formed in the upper portion of the guide 180.

Since the rotation motor 160, the fan 150 and the fan motors 154 and 155, which are main components causing vibration of the dryer 100, are fixed to the inner sleeve 112, management and reduction of vibration of the fan motors 154 and 155 and the rotation motor 160 may be achieved by the inner sleeve 112. In other words, it is possible to simultaneously reduce vibration generated by the fan motors 154 and 155 and the rotation motor 160 by disposing a vibration-absorbing material or a vibration isolation material (VIM) between the outer peripheral surface of the inner sleeve 112 and the inner peripheral surfaces of the upper and lower casings 110*a* and 110*b*. Alternatively, in order to reduce the vibrations, the inner sleeve 112 may include a vibration isolation material, and the outer peripheral surface of the inner sleeve 112 may be brought into close contact with the inner peripheral surface of the upper and lower casings 110*a* and 110*b*.

According to the embodiment, the inner sleeve 112 may be provided at a downstream side thereof with the discharge tube 170 and may be configured to have the form of a venturi tube. In other words, the inner sleeve 112 may be configured such that the diameter thereof decreases at an increasing rate moving in a downstream direction. Accordingly, due to a well-known "venturi effect", as the pressure of air passing through the inner sleeve 112 is decreased (or the flow rate of air is increased), entrainment of ambient air into the inner sleeve 112 is facilitated, whereby it is possible to expect the performance of the fan 150 to be increased.

The present disclosure offers one or more of the following effects.

It is possible to minimize generation of overheating, noise or vibration attributable to operation of the fan 150 and to control the discharge amount or discharge rate of drying air in a stepwise manner, in contrast to a dryer 100 provided with a single fan. To this end, the fan 150 of the dryer 100 may include the first and second fans 151 and 152, and the first and second fans 151 and 152 may rotate about an imaginary axis Ia shared by the first and second fans 151 and 152.

Since the blades 151*b* of the first fan 151 and the blades 152*b* of the second fan 152 are inclined in opposite directions with respect to the imaginary axis Ia, that is, the rotational axis, it is possible to cause air to flow in the same direction even when the first and second fans 151 and 152 are rotated in opposite directions.

Since the circumferential component velocity of airflow, which is increased when the air passes through the first fan 151, is decreased when the air passes through the second fan 152, it is possible to improve the straightness of the flow of air passing through the second fan 152. Accordingly, there are advantages in that the structure of the dryer 100 is simplified since there is no need to provide a structure such as an additional vane for improving the straightness of airflow and in that it is possible to solve the problem of deteriorated performance of the fan 150 due to the action of drag or frictional force attributable to the provision of a vane.

It is possible to increase the intake rate of air since the first fan 151 having a relatively small number of blades 151*b* is positioned upstream of the second fan 152.

It is possible to discharge mild wind since the second fan 152 having a relatively large number of blades 152*b* is positioned downstream of the first fan 151.

Since the side surface of the rear cap 140, which surrounds the first fan 151 and which corresponds to the outer periphery of the first fan 151, is provided with a plurality of through holes 140*a*, it is possible to further facilitate the introduction of air into the first fan 151.

Since the radius of the hub 151*a* of the first fan 151 and the radius of the hub 152*a* of the second fan 152 are the same, and the distance between the blade tip of the first fan 151 and the center of the hub 151*a* of the first fan 151 is the same as the distance between the blade tip of the second fan 152 and the center of the hub 152*a* of the second fan 152, it is possible to prevent an undesired vortex from being generated in the airflow passing through the first and second fans 151 and 152.

Since the discharge tube 170, from which drying air is discharged, is constructed so as to be rotated in at least one direction, it is possible to diffusely discharge the drying air to a region to be dried.

Since the protrusions 175 of the discharge tube 170 are slidably moved along the groove 184 formed in the inner peripheral surface of the guide 180, the discharge tube 170 is able to be rotated along the shape of the groove 184. Here, the shape of the groove 184 may be a circular or wave shape. When the shape of the groove 184 is a wave shape, the discharge tube 170 is able to rotate about at least two axes.

The discharge tube 170 is able to be rotated automatically by the power from the rotation motor 160. To this end, the connector 164, which transmits the power from the rotation motor 160 to the discharge tube 170, may be connected at one end thereof to the rotating shaft 161 of the rotation motor 160 and at the other end thereof to the discharge tube 170.

Since the connector 164 extends in a direction orthogonal to the rotating shaft 161 of the rotation motor 160, and both ends of the connector 164 are rotatably fitted into the discharge tube 170, the discharge tube 170 is able to rotate both about the rotating shaft 161 of the rotation motor 160 and about the longitudinal axis of the connector 164.

Since the fan 150 is fixed to the inner sleeve 112, on which the rotation motor 160 is mounted, via the fixing rods 158, it is possible to manage and reduce vibrations of the rotation motor 160 and the fan 150 by means of the inner sleeve 112.

Since each of the fixing rods 158 of the fan 150, which is fixed to the inner sleeve 112, is bent at lateral side portion thereof at least once, it is possible to increase the rigidity of the fixing rods 158.

The dryer 100 according to the embodiments of the present disclosure have been described with reference to the accompanying drawings. However, those skilled in the art will appreciate that the present disclosure is not limited to the above embodiments and various modifications, additions and substitutions are possible, without departing from the scope and spirit of the disclosure as disclosed in the accompanying claims.

What is claimed is:

1. A dryer, comprising:

a hollow casing having a front opening and a rear opening;

a first fan located within the casing;

a second fan located within the casing and positioned downstream of the first fan, the first fan and the second fan being arranged to produce a flow of air through the casing from the rear opening to the front opening, the first fan and the second fan being configured to rotate in opposite directions about a common axis to produce the flow of air;

a heater located within the casing to heat the air introduced into the casing; and a discharge tube located within the casing, the discharge tube including an air inlet at a rear side of the discharge tube into which the air is introduced and an air outlet at a front side of the discharge tube through which the air is discharged, wherein the casing comprises a plurality of through holes spaced apart from the rear opening, and wherein the plurality of through holes overlap with the first fan in a radial direction of the first fan, and do not overlap with the second fan in a radial direction of the second fan.

2. The dryer according to claim 1, wherein the first fan is an axial flow fan and comprises:

a first fan motor having a first rotating shaft that extends along the common axis;

a first hub connected to the first rotating shaft; and a plurality of first blades coupled to an outer peripheral surface of the first hub, and wherein the second fan is an axial flow fan and comprises:

a second fan motor having a second rotating shaft that extends along the common axis;

a second hub connected to the second rotating shaft; and a plurality of second blades coupled to an outer peripheral surface of the second hub.

3. The dryer according to claim 2, wherein the first blades are coupled to the outer peripheral surface of the first hub to form first blade roots, wherein the second blades are coupled to the outer peripheral surface of the second hub to form second blade roots, and wherein the first blades and the second blades are inclined in opposite directions with respect to the common axis.

4. The dryer according to claim 3, wherein each of the first blade roots is configured such that, when the first fan is rotated in a first direction, an end of the first blade root in the first direction is positioned further upstream than an end of the first blade root in a direction opposite to the first direction, and wherein each of the second blade roots is configured such that, when the second fan is rotated in a second direction opposite to the first direction, an end of the second blade root in the second direction is positioned further upstream than an end of the second blade root in a direction opposite the second direction.

5. The dryer according to claim 3, wherein a number of the second blades is greater than a number of the first blades.

6. The dryer according to claim 3, wherein the first fan motor is received within the first hub, wherein the second fan motor is received within the second hub, wherein the first rotating shaft extends from the first fan motor toward an upstream direction, and wherein the second rotating shaft extends from the second fan motor toward a downstream direction.

7. The dryer according to claim 3, wherein the first hub has a first radius, wherein the second hub has a second radius equal to the first radius, and wherein a distance between a tip of one of the first blades and a center of the first hub is equal to a distance between a tip of one of the second blades and a center of the second hub.

8. The dryer according to claim 1, wherein the discharge tube is rotatably coupled to the casing about at least one axis.

9. The dryer according to claim 8, further comprising a cylindrical guide disposed within the casing, the cylindrical guide including a groove provided in an inner surface of the cylindrical guide, wherein the discharge tube includes a protrusion located on an outer surface of the discharge tube, the protrusion being located within the groove and slidably movable along the groove.

10. The dryer according to claim 9, wherein the groove forms a closed curve in the inner surface of the cylindrical guide so that the protrusion is continuously movable along the groove when the discharge tube is rotated.

11. The dryer according to claim 10, wherein a shape of the groove is a circular shape that extends in a circumferential direction.

12. The dryer according to claim 10, wherein a shape of the groove is a wave shape.

13. The dryer according to claim 12, wherein the protrusion comprises a pair of protrusions that are spaced apart from each other by 180 degrees in a rotation direction of the discharge tube.

14. The dryer according to claim 12, further comprising:

a rotation motor having a rotation shaft rotatable about a first axis; and a connector having a first end connected to the rotation shaft and a second end connected to the discharge tube, the connector being configured to rotate the discharge tube about the first axis, wherein the discharge tube is rotated both about the first axis and about a second axis oriented at a predetermined angle relative to the first axis upon activation of the rotation motor.

15. The dryer according to claim 14, wherein the discharge tube comprises a pair of recess portions that are spaced apart from each other by 180 degrees in a rotation direction of the discharge tube, and wherein opposing ends of the connector are rotatably fitted into respective ones of the pair of recess portions.

16. The dryer according to claim 8, wherein a size of the air outlet of the discharge tube is smaller than a size of the air inlet of the discharge tube, wherein the size of the air outlet comprises a length and a width, and wherein the length is greater than the width.

17. A dryer, comprising:

a hollow casing having a front opening and a rear opening;

a fan located within the casing, the fan being arranged to produce a flow of air through the casing from the rear opening to the front opening, the fan including a plurality of fixing rods projecting outwardly in a radial direction;

a heater located within the casing to heat the air introduced into the casing;

a discharge tube located within the casing, the discharge tube including an air inlet at a rear side of the discharge tube into which the air is introduced and an air outlet at a front side of the discharge tube through which the air is discharged, the discharge tube rotatably coupled to the casing about at least one axis;

an inner sleeve located within the casing and positioned between the fan and the discharge tube; and a rotation motor coupled to an inside of the inner sleeve, the rotation motor configured to rotate the discharge tube, wherein the fixing rods are coupled to the inside of the inner sleeve.

18. The dryer according to claim 17, wherein the inner sleeve comprises a plurality of grooves, the grooves being circumferentially spaced apart from one another, wherein each of the fixing rods includes a plate portion extending at an angle with respect to the radial direction, and wherein each plate portion is fitted into a corresponding one of the grooves.

19. The dryer according to claim 17, wherein the inner sleeve extends along an inner side of the casing between the fan and the discharge tube, and wherein the inner sleeve has a shape of a venturi tube.

* * * * *